US009216889B2

(12) United States Patent
Morayko

(10) Patent No.: US 9,216,889 B2
(45) Date of Patent: Dec. 22, 2015

(54) SELF-CLOSING GRAVITY-ACTUATED TAP

(75) Inventor: Yuriy B. Morayko, Calgary (CA)

(73) Assignee: 1351910 Alberta Inc., Calgary, Alberta (CA)

( * ) Notice: Subject to any disclaimer, the term of this patent is extended or adjusted under 35 U.S.C. 154(b) by 833 days.

(21) Appl. No.: 13/297,181

(22) Filed: Nov. 15, 2011

(65) Prior Publication Data

US 2013/0119084 A1 May 16, 2013

(51) Int. Cl.

| | |
|---|---|
| ***B65D 47/28*** | (2006.01) |
| ***B65D 47/36*** | (2006.01) |
| ***B67D 3/02*** | (2006.01) |
| ***B65D 47/24*** | (2006.01) |
| ***B05B 1/30*** | (2006.01) |

(52) U.S. Cl.

CPC ..... *B67D 3/02* (2013.01); *B05B 1/3013* (2013.01); *B65D 47/248* (2013.01)

(58) Field of Classification Search

CPC ..... F16K 1/443; B65D 47/248; B67D 3/02; B05B 1/3013

USPC ..... 222/81, 82, 501, 509, 322; 251/339

See application file for complete search history.

(56) References Cited

U.S. PATENT DOCUMENTS 995,340 A * 6/1911 Garnet ..... 222/476
1,064,549 A * 6/1913 Schmeykal ..... F16K 21/04 251/100
1,903,605 A 8/1931 Allen
RE22,837 E * 1/1947 Sanchis ..... 141/296
2,710,594 A 6/1955 Thompson
2,785,881 A 3/1957 Dolan
3,128,745 A 4/1964 Alter
3,805,990 A * 4/1974 Palaudarias ..... 220/281
3,887,165 A 6/1975 Thompson
4,133,345 A 1/1979 Mitchell
4,372,467 A * 2/1983 Pritchitt ..... G03G 15/104 222/501
4,456,222 A 6/1984 Shen
4,512,551 A 4/1985 Dalferth
4,717,051 A * 1/1988 Leclerc ..... B67D 3/02 141/364
4,840,351 A 6/1989 Lii
4,940,206 A 7/1990 Chung-Shan
4,981,160 A 1/1991 Sen-Tein
5,131,622 A 7/1992 Chang
5,154,212 A * 10/1992 Weber ..... A47K 5/13 141/353
5,286,000 A 2/1994 Katz
5,288,053 A 2/1994 Young
5,651,531 A * 7/1997 Lu ..... 251/229
5,704,397 A 1/1998 Lu
6,131,608 A 10/2000 Lu
6,131,774 A * 10/2000 Thomas ..... G01F 11/34 222/181.2
6,478,178 B2 * 11/2002 Montgomery ..... 220/203.13
6,739,572 B2 5/2004 Shen
6,942,195 B2 9/2005 Kao
7,090,195 B1 8/2006 Huang
7,093,615 B2 * 8/2006 Shane ..... 137/801
7,950,624 B2 5/2011 Liao
7,975,980 B2 7/2011 Gao

* cited by examiner

*Primary Examiner* — Daniel R Shearer

(74) *Attorney, Agent, or Firm* — Schwabe, Williamson & Wyatt

(57) ABSTRACT

A tap for dispensing flowable materials. The tap includes a body and a plunger positioned within a channel in the body. The plunger is movable between first, second, and third positions. The plunger and the body form a first seal when the plunger is in the first position, and a second seal when the plunger is in the second position. Flowable material may pass through the channel when the plunger is the third position. The tap also includes a connector to sealingly engage the body with a flowable material source and establish fluid communication between the flowable material source and the channel.

18 Claims, 24 Drawing Sheets

SELF-CLOSING GRAVITY-ACTUATED TAP

FIELD

The present disclosure relates to a tap for dispensing fluids. More particularly, the present disclosure relates to self-closing taps.

BACKGROUND

Self-closing, gravity actuated taps are well-known in the field of fluid dispensers. Gravity-actuated taps often have a conical valve or ball valve, for example with a metal-to-metal seat. In order for the valve to function effectively, the taps must be installed substantially vertically. The taps may be spring actuated self-closing water taps with time delays, for example the spring loaded self-closing water tap in PCT Publication WO 95/33153.

U.S. Pat. No. 7,975,980 to Gao et al. describes an adjustable time-controlled water valve. A time-control apparatus includes an elastomer and a push rod. The elastomer is disposed between a support lid and the push rod. When the push rod is pushed, the water valve is opened. After a certain time, the water pressures are balanced and the elastomer, which has been compressed, will push the push rod back to its initial position to close the valve.

U.S. Pat. No. 5,288,053 to Young describes a discharge controlling device for faucet in which a control lever is used to push a throttle pin axially positioned within the center of the inner sleeve, such that the pin is slidably moved up and down and engages a steel ball to control the opening and closing of a water discharge aperture. As the control lever is pushed by hand and moved from its closed position to the intermediate or open position where the water can be admitted, the steel ball is pushed away from the aperture by the rod tip of the throttle pin. When the control lever is released, the throttle pin falls, and the steel ball, which is subject to water pressure, immediately returns to the position where it closes the aperture. As the control lever is moved manually from its closed position to its open position, the control lever is secured within the locking slot. This locking effect of the slot effectively allows the aperture to remain open after the control lever is released. When the control lever is disengaged from the locking slot, the throttle pin drops and the steel ball, due to the action of water pressure, moves to close the aperture.

Many previous self-closing gravity actuated taps are used in pressurized and centralized water systems. Such self-closing taps are not useful in locations lacking centralized water systems, for example camp sites, hiking trails, and disaster zones. A large number of parts in these taps reduces the taps' reliability and increases their cost. A common problem with many prior art self-closing taps is that they are susceptible to leakage during transport when attached to a fluid source.

Electrical water taps with self-closing valves are extensively used in public washrooms and other facilities to minimize water waste. In addition to their complexity, such water taps require an electrical power source.

Many conventional taps currently used for dispensing water from containers not connected to centralized water distribution systems, do not have self-closing properties. Such taps are often used in locations where water is scarce but do not facilitate efficient water use.

With clean water in increasingly short supply and increased awareness of proper hygiene, there is a need for low cost, efficient water taps which can be used in low-pressure applications and in remote locations. It is, therefore, desirable to provide such a tap.

SUMMARY

It is an object of the present disclosure to obviate or mitigate at least one disadvantage of previous self-closing taps.

In a first aspect, the present disclosure provides a tap for dispensing flowable materials. The tap includes a body and a plunger positioned within a channel in the body. The plunger is movable between first, second, and third positions. The plunger and the body form a first seal when the plunger is in the first position, and a second seal when the plunger is in the second position. Flowable material may pass through the channel when the plunger is the third position. The tap also includes a connector to sealingly engage the body with a flowable material source and establish fluid communication between the flowable material source and the channel.

In a further aspect, the present disclosure provides a gravity actuated tap for dispensing a flowable material from a container. The tap includes a body having a channel extending longitudinally between a first body end and a second body end, the channel including an inlet for receiving the flowable material and an outlet for discharging the flowable material, the channel arranged for flow of the flowable material therethrough; and an elongate plunger movable along a length of the channel. The plunger includes a plunger shaft having a first plunger shaft end and a second plunger shaft end; a first sealing surface proximate the first plunger shaft end to form a first seal with the body when the plunger is in a first position, wherein at least a portion of the first sealing surface has a greater cross-sectional surface area transversely to the length of the channel than at least a portion of the plunger shaft; and a second sealing surface proximate the first sealing surface to form a second seal with the body when the plunger is in a second position. At least a portion of the second sealing surface has a greater cross-sectional surface area transversely to the length of the channel than at least a portion of the first sealing surface. When the plunger is in a third position, the plunger is positioned for providing a flow of the flowable material through the channel. The tap also includes a connector for attaching the tap to the container.

In an embodiment, the cross-sectional surface area of the plunger increases along a length of the first sealing surface from the first plunger shaft end.

In an embodiment, the cross-sectional surface area of the plunger decreases along a length of the second sealing surface from the first sealing surface.

In an embodiment, the tap includes a first sealing element affixed to the body to form the first seal with the first sealing surface and to form the second seal with the second sealing surface In an embodiment, the tap includes a sealing shoulder extending from the body to form the first seal with the first sealing surface and to form the second seal with the second sealing surface.

In an embodiment, the connector is a collar extending from the first body end and at least a portion of the channel is coextensive with the collar.

In an embodiment, the connector includes an extension extending from the first body end, wherein at least a portion of the channel is coextensive with the extension, and a fastener to engage the extension.

In an embodiment, the connector includes an extension extending from the first body end, wherein at least a portion of the channel is coextensive with the extension and a fastener to engage the extension, and wherein the extension is a threaded extension, and the fastener is a nut.

In an embodiment, the tap includes a second sealing element affixed to the body proximate the first body end to form a third seal between the tap and the container.

In an embodiment, the tap includes a guiding element affixed to the body for guiding the plunger along the length of the channel.

In an embodiment, the tap includes a guiding element affixed to the body for guiding the plunger along the length of the channel and the plunger extends through a plunger aperture of the guiding element, the plunger aperture for restricting lateral motion of the plunger.

In an embodiment, the tap includes a plunger stop extending from the second sealing surface to abut the body proximate the first body end when the plunger is in the second position.

In an embodiment, the tap includes a plunger stop extending from the second sealing surface to abut the body proximate the first body end when the plunger is in the second position, and a plunger seat proximate the first body end for receiving the plunger stop.

In an embodiment, the tap includes a sealing cavity formed in a portion of the plunger proximate the second sealing surface to facilitate movement of the plunger between the first and second positions.

In an embodiment, the tap includes a handle proximate the second plunger shaft end.

In an embodiment, the tap includes a handle proximate the second plunger shaft end and a knife proximate the handle for cutting an aperture in the container.

In an embodiment, the tap includes a handle proximate the second plunger shaft end, a knife proximate the handle for cutting an aperture in the container, and an anchor element proximate the handle to anchor the knife to the container while cutting an aperture in the container, and a cutter offset from the anchor element to rotationally cut the aperture while the anchor element is anchored to the container.

In an embodiment, the tap includes a handle proximate the second plunger shaft end, a knife proximate the handle for cutting an aperture in the container, and a knife guard removably nested about the knife for enclosing the knife.

In an embodiment, the tap includes a handle proximate the second plunger shaft end and the handle is removably attached to the second plunger end.

In a further aspect, the present disclosure provides a gravity-actuated tap for dispensing flowable material from a container, the tap including a body having a channel, extending longitudinally between a first body end and a second body end, the channel including an inlet for receiving the flowable material and an outlet for discharging the flowable material, the channel arranged for flow of the flowable material therethrough; a first body sealing surface proximate the first body end; and a second body sealing surface between the first body sealing and the second body end, wherein the cross-sectional area of the channel along at least a portion of a the first body sealing surface is greater that the cross-sectional area of the channel along at least a portion of the second body sealing surface. The tap also includes an elongate plunger movable along a length of the channel, the plunger comprising a plunger shaft having a first plunger shaft end and a second plunger shaft end, wherein the plunger forms a first seal with the first body sealing surface when the plunger is in a first position, wherein the plunger forms a second seal with the second body sealing surface when the plunger is in a second position, and wherein when the plunger is in a third position, the plunger is positioned for providing a flow of the flowable material through the channel; and a connector for connecting the body with a container.

In an embodiment, the cross-sectional area of the channel decreases along a length of the first body sealing surface from the first body end.

In an embodiment, the cross-sectional area of the channel increases along a length of the second body sealing surface from the first body sealing surface.

In an embodiment, the tap includes a first sealing element affixed to the plunger to form the first seal with the first body sealing surface and to form the second seal with the second body sealing surface.

In an embodiment, the tap includes a first sealing element affixed to the plunger to form the first seal with the first body sealing surface and to form the second seal with the second body sealing surface, and a sealing cavity formed in a portion of the plunger proximate the first plunger shaft end to facilitate movement of the plunger between the first and second positions, and relief channels to establish fluid communication between the first sealing element and the sealing cavity to facilitate movement of the plunger between the first and second positions.

In an embodiment, the tap includes a plunger sealing shoulder extending from the plunger to form the first seal with the first body sealing surface and to form the second seal with the second body sealing surface.

In an embodiment, the connector is a collar extending from the first body end and at least a portion of the channel is coextensive with the collar.

In an embodiment, the connector includes an extension extending from the first body end, wherein at least a portion of the channel is coextensive with the extension; and a fastener to engage the extension.

In an embodiment, the connector includes an extension extending from the first body end, wherein at least a portion of the channel is coextensive with the extension; and a fastener to engage the extension, and the extension is a threaded extension and the fastener is a nut.

In an embodiment, the tap further includes a second sealing element affixed to the body proximate the first body end to form a third seal between the tap and the container.

In an embodiment, the tap further includes a guiding element affixed to the body for guiding the plunger along the length of the channel.

In an embodiment, the tap further includes a guiding element affixed to the body for guiding the plunger along the length of the channel, and the plunger extends through a plunger aperture of the guiding element, the plunger aperture for restricting lateral motion of the plunger.

In an embodiment, the tap further includes a plunger stop extending from the first plunger shaft end to abut the body proximate the first body end when the plunger is in the second position.

In an embodiment, the tap further includes a sealing cavity formed in a portion of the plunger proximate the first plunger shaft end to facilitate movement of the plunger between the first and second positions.

In an embodiment, the tap further includes a handle proximate the second plunger shaft end.

In an embodiment, the tap further includes a handle proximate the second plunger shaft end and a knife proximate the handle for cutting an aperture in the container.

In an embodiment, the tap further includes a handle proximate the second plunger shaft end, a knife proximate the handle for cutting an aperture in the container, and an anchor element proximate the handle to anchor the knife to the container while cutting an aperture in the container, and a cutter offset from the anchor element to rotationally cut the aperture while the anchor element is anchored to the container.

In an embodiment, the tap further includes a handle proximate the second plunger shaft end, a knife proximate the handle for cutting an aperture in the container, and an anchor element proximate the handle to anchor the knife to the container while cutting an aperture in the container, and a knife guard removably nested about the knife for enclosing the knife.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached figures.

DETAILED DESCRIPTION

Generally, the present disclosure describes an apparatus and system for dispensing substances from containers. The subject matter of the present disclosure provides a self-closing gravity-actuated tap that may be used to efficiently dispense flowable materials, for example water. The subject matter of the present disclosure may be applied to dispense water from containers, for example standard water bottles, in locations where a centralized water supply is not available, for example in remote locations or disaster zones. The subject matter of the present disclosure may, for example, be applied to dispense flowable materials at low pressure, for example below the tap pressure of common residential taps. The flowable materials may be dispensed, for example, for hygienic purposes such as hand washing.

Tap

Figure 1:
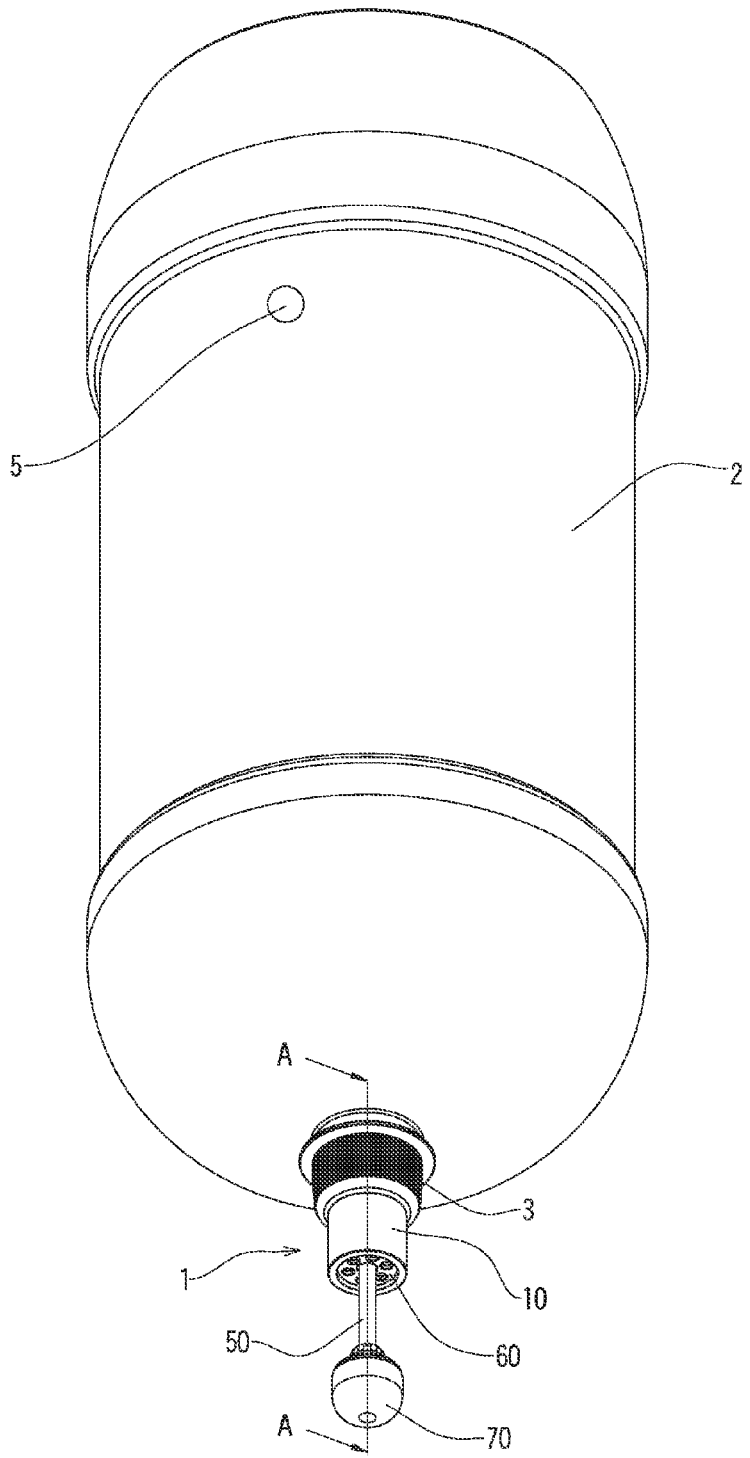
FIG. 1 is a perspective view of a gravity-actuated tap installed on a container.

FIG. 1 is perspective view of a gravity-actuated tap 1 installed on a container 2. The container 2 may be a conventional plastic beverage bottle, for example a water bottle. The gravity-actuated tap 1 is shown installed on a cap 3 of the container 2. Alternatively, the gravity-actuated tap 1 may be installed directly on the container 2 (not shown). The gravity-actuated tap 1 may also be installed on other containers, for example a canister, barrel, plastic bag type liquid container, or portable shower. Alternatively, the gravity-actuated tap 1 may be installed on fluid conduits, for example on the end of a hose, a pipe, or on an adapter for a hose or pipe. A substance in the container 2 may be any flowable material, for example water. Other substances may include any fluids, powders, or granular material, suitable for dispensing through the gravity-actuated tap 1.

Figure 2:
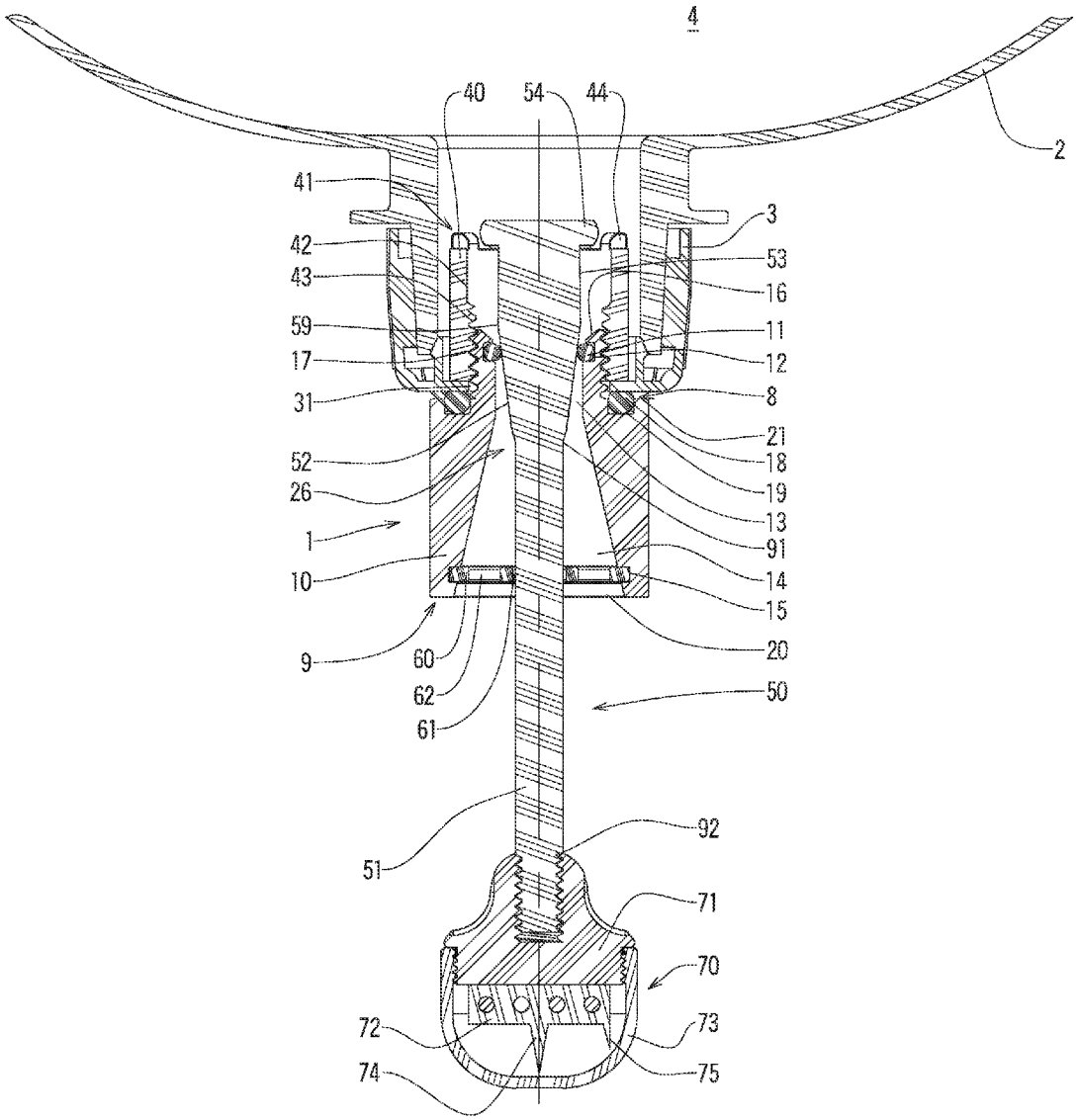
FIG. 2 is a cross-sectional view of the gravity-actuated tap and container of FIG. 1 along line A-A.
Figure 3:
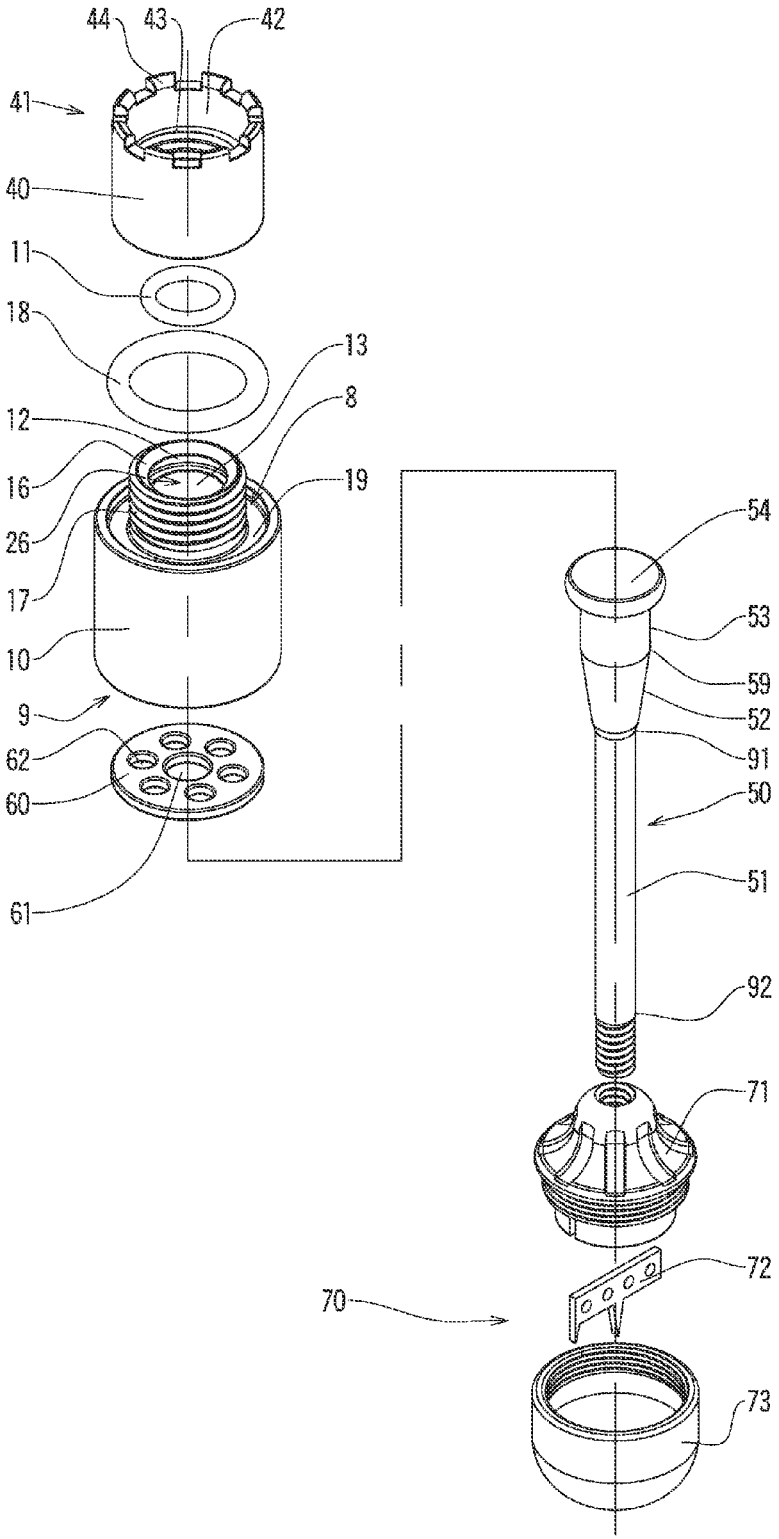
FIG. 3 is an exploded perspective view of the gravity-actuated tap of FIG. 1.

FIG. 2 is a cross-sectional view of the gravity-actuated tap 1 in a first position, container 2, and cap 3 of FIG. 1 along line A-A. FIG. 3 is an exploded perspective view of the tap of FIG. 1. The gravity-actuated tap 1 includes a body 10 having an inlet 13 at a first body end 8 and an outlet 14 at a second body end 9. Together, the inlet 13 and the outlet 14 define a channel 26 therebetween. The outlet 14 is in fluid communication with the inlet 13. When the gravity-actuated tap 1 is connected to the container 2, the inlet 13 is in fluid communication with the container 2.

The body 10, inlet 13, and outlet 14 may be any suitable shape. The body may be manufactured from any suitable material. In one embodiment, the body 10 may be manufactured from materials such as rigid materials (including metals), semi-rigid materials, or soft materials (for example polyethelyne plastic, rubber, or other flexible polymers). A skilled person will understand that injection molding, machining, or other techniques may be used to fabricate the body 10. The inlet 13 and outlet 14 may be circular in plan view. For example, the inlet 13 and outlet 14 may be cylindrical or frustoconical in plan view. In one embodiment, the outlet 14 may be frustoconical such that the cross-sectional area of the outlet 14 transversely to the length of the channel 26 increases from the inlet 13 along the outlet 14 to the mouth 20. Alternatively, the inlet 13 and outlet 14 may for example be ovular, square, rectangular, or any suitable shape in plan view.

The gravity-actuated tap 1 includes a plunger 50 movable within the channel 26. The plunger 50 includes a plunger shaft 51, a first sealing surface 52, and a second sealing surface 53. The plunger shaft 51 has a first plunger shaft end 91 and a second plunger shaft end 92. At least a portion of the first sealing surface 52 of the plunger 50 has a greater cross-sectional area transversely to the length of the channel 26 than at least a portion of the plunger shaft 51. At least a portion of the second sealing surface 53 of the plunger 50 has a greater cross-sectional area transversely to the length of the channel 26 than at least a portion of the first sealing surface 52.

In one embodiment, the first sealing surface 52 extends from the first plunger shaft end 91 and the second sealing surface 53 extends from the first sealing surface 52. In another embodiment, the first sealing surface 52 is continuous with the second sealing surface 53 and a sealing surface interface 59 is located between the first sealing surface 52 and the second sealing surface 53. In one embodiment, the sealing surface interface 59 is the maximum point of cross-sectional area of the plunger 50 transversely to the length of the channel 26 located between the first sealing surface 52 and the second sealing surface 53. The plunger 50 may have a cross-sectional area transversely to the length of the channel 26 greater than the sealing surface interface 59 at other portions of the plunger 50. For example, the plunger 50 may include a plunger stop 54 extending from to the second sealing surface 53. In another example, a handle assembly 70 may extend from the second plunger shaft end 92. In another example, the second sealing surface 53 may have a cross-sectional area transversely to the length of the channel 26 equal to that of the sealing surface interface 59.

The plunger 50 may be manufactured from any suitable material. Plunger 50 materials may include rigid materials (including metals), semi-rigid materials, or soft materials (for example polyethelyne plastic, rubber, or other flexible polymers). A skilled person will understand that injection molding, machining, or other techniques may be used to fabricate the plunger 50. The plunger 50 has a cross-sectional shape suitable to allow the plunger 50 to move within in the channel 26. In one embodiment, the cross-sectional shape of the plunger 50 corresponds to the cross-sectional shape of the channel 26. For example, the plunger 50 and the channel 26 could each be circular, ovular, square, rectangular, or any suitable shape in plan view In one embodiment, the cross-sectional area of the first sealing surface 52 may change along the length of the plunger 50. For example, the first sealing surface 52 may be frustoconical or any shape wherein the cross-sectional plan area of the plunger 50 gradually increases from the plunger shaft 51 to the second sealing surface 53. In another example, the second sealing surface 53 may be frustoconical or any shape wherein the cross-sectional plan area of the plunger 50 gradually decreases from the second sealing surface 53, for example, from the sealing surface interface 59, to a smaller value adjacent to the plunger stop 54. Alternatively, the second sealing surface 53 may be cylindrical or any shape wherein the cross-sectional plan area of the plunger 50 remains substantially constant along the second sealing surface 53.

The gravity-actuated tap 1 includes features that facilitate the formation of a seal between the body 10 and the plunger 50 when the plunger 50 is in a first position (FIG. 2) or a second position (FIG. 5) as described below. In the first position, a first seal may be formed at the first sealing surface 52 of plunger 50 with the body 10. In the second position, a second seal may be formed at the second sealing surface 53 of the plunger 50 with the body 10. In one embodiment, the gravity-actuated tap 1 may include a first sealing element 11 to form a seal between the body 10 and the plunger 50. The first sealing element 11 may be an o-ring (FIG. 2), a frustoconical sealing element (FIG. 17), a half-o-ring sealing element (FIG. 18), or any other sealing element that a skilled person would understand to be suitable. The first sealing element 11 may be manufactured from any suitable material. In one embodiment, the first sealing element 11 is made from a flexible or resilient material, for example rubber or a flexible polymer. Alternatively, the first sealing element 11 is made from rigid materials or semi-rigid materials.

Figure 10:
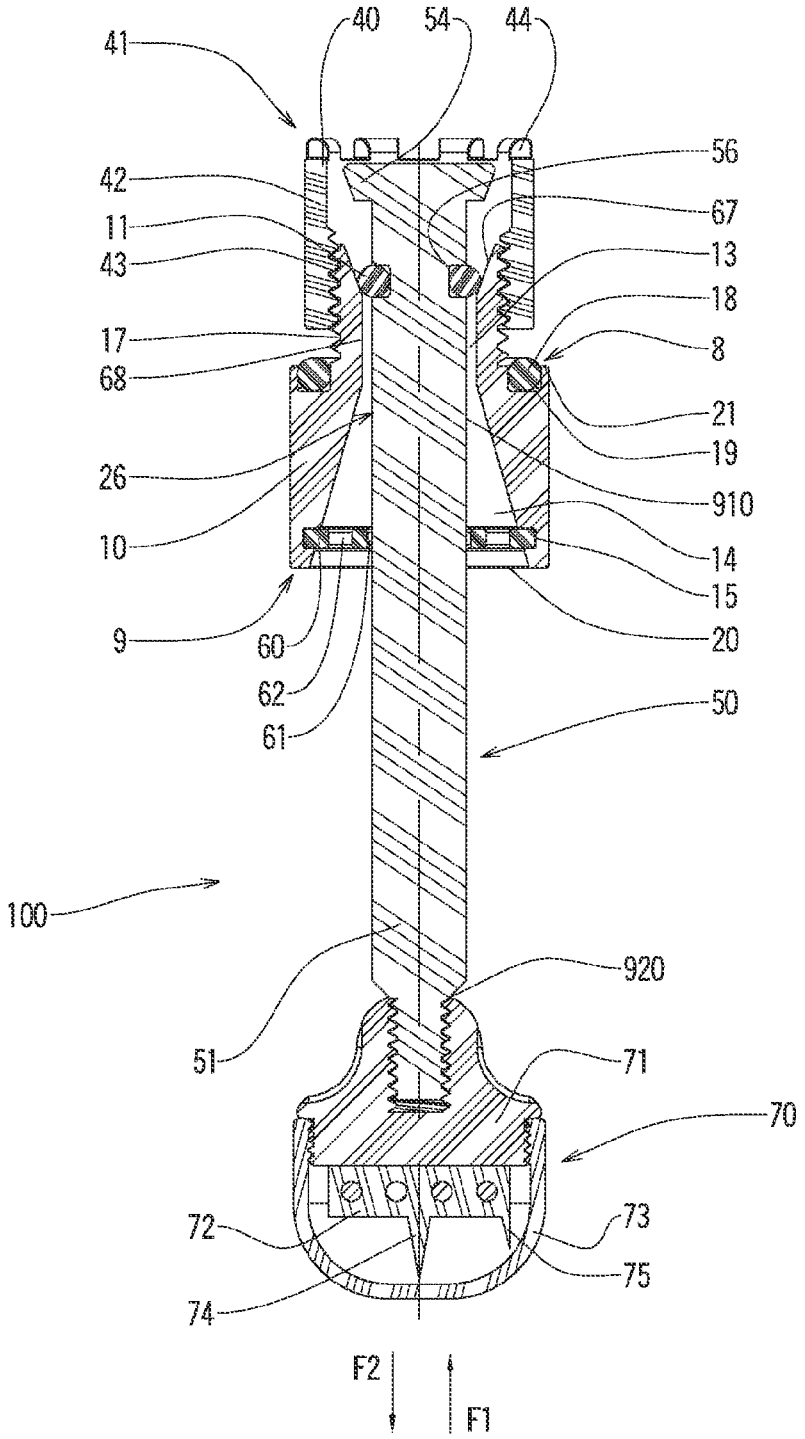
FIG. 10 is a cross-sectional elevation view of a gravity-actuated tap in a first position.
Figure 12:
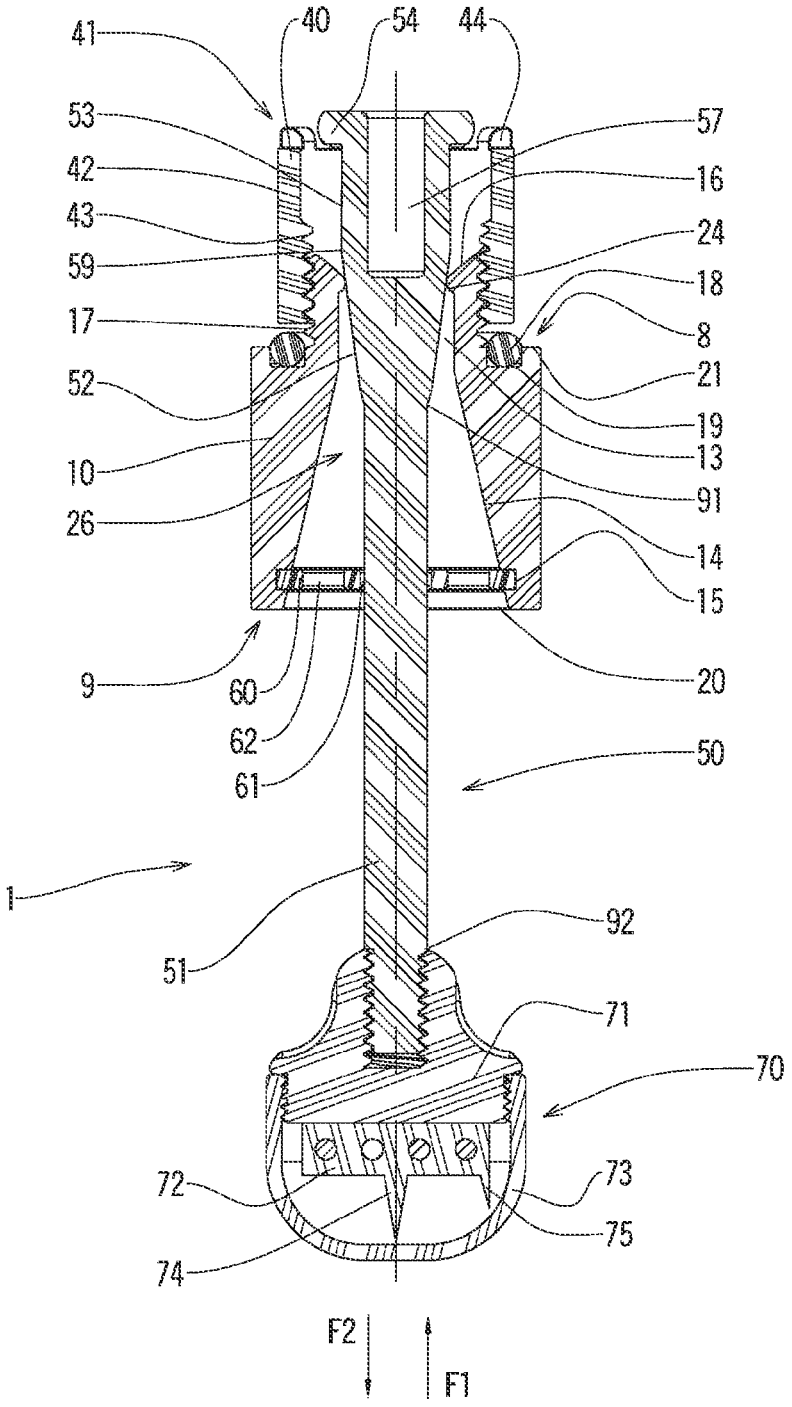
FIG. 12 is a cross-sectional elevation view of a gravity-actuated tap in a first position.

In one embodiment, the gravity-actuated tap 1 may include a first sealing element 11 affixed to the body to form a seal between the body 10 and the plunger 50. In one embodiment, the first sealing element 11 may be housed within the body 10. For example, a first sealing element groove 12 may be present on an inner surface of the body 10 to house the first sealing element 11. Alternatively, the first sealing element 11 may be affixed to the body 10 in any manner that a skilled person would understand to be suitable. In one embodiment, the gravity-actuated tap 1 may include a sealing shoulder 24 to form a seal between the body 10 and the plunger 50 as shown in FIG. 12 and described below. In one embodiment, the gravity-actuated tap 1 may include a first sealing element 11 affixed to the plunger 50 to form a seal between the body 10 and the plunger 50. In one embodiment, the first sealing element 11 may be housed within the plunger 50 as shown in FIG. 10 and described below. For example, a plunger groove 56 may be present on the plunger 50 to house the first sealing element 11. Alternatively, the first sealing element 11 may be affixed to the plunger 50 in any manner that a skilled person would understand to be suitable. Without being bound by any theory, the force of the weight of the plunger 50, the handle assembly 70, and a static head of the flowable material 4 in the container 2, may assist with formation of the first seal and facilitate the plunger 50 remaining in the first position.

The gravity-actuated tap 1 includes a connector to attach the body 10 to the container 2 and establish fluid communication between the container 2 and the channel 26. Any connector suitable for establishing fluid communication between the container 2 and the channel 26 of the gravity-actuated tap 1 may be used. For example, the connector may be an extension 17 and fastener 40. The extension 17 may extend from the body 10 proximate the first body end 8 to extend through an aperture 31 in the cap 3 and engage the fastener 40. The extension 17 may be a threaded extension that engages the fastener 40 and the fastener 40 may be an installation nut. At least a portion of the channel 26 may be coextensive with the extension 17. In one embodiment, the body 10 may include a plunger seat 16 for abutting the plunger 50. For example, the plunger seat 16 may extend from the connector, for example extension 17, for abutting the plunger 50. Alternatively, the connector may be a collar (see FIGS. 13 and 14 and the below description for an example of a collar).

In one embodiment, the gravity-actuated tap 1 may include a second sealing element 18 to form a seal between the body sealing surface 21 of the body 10 and the cap 3 (FIG. 2). The second sealing element 18 may be manufactured from any suitable material. In one embodiment, the second sealing element 18 is made from a resilient flexible material, for example rubber or a flexible polymer. Alternatively, the second sealing element 18 is made from rigid materials or semi-rigid materials. In one embodiment, the body sealing surface 21 may include a second sealing element groove 19 to provide a seat for the second sealing element 18.

Operation

Figure 4:
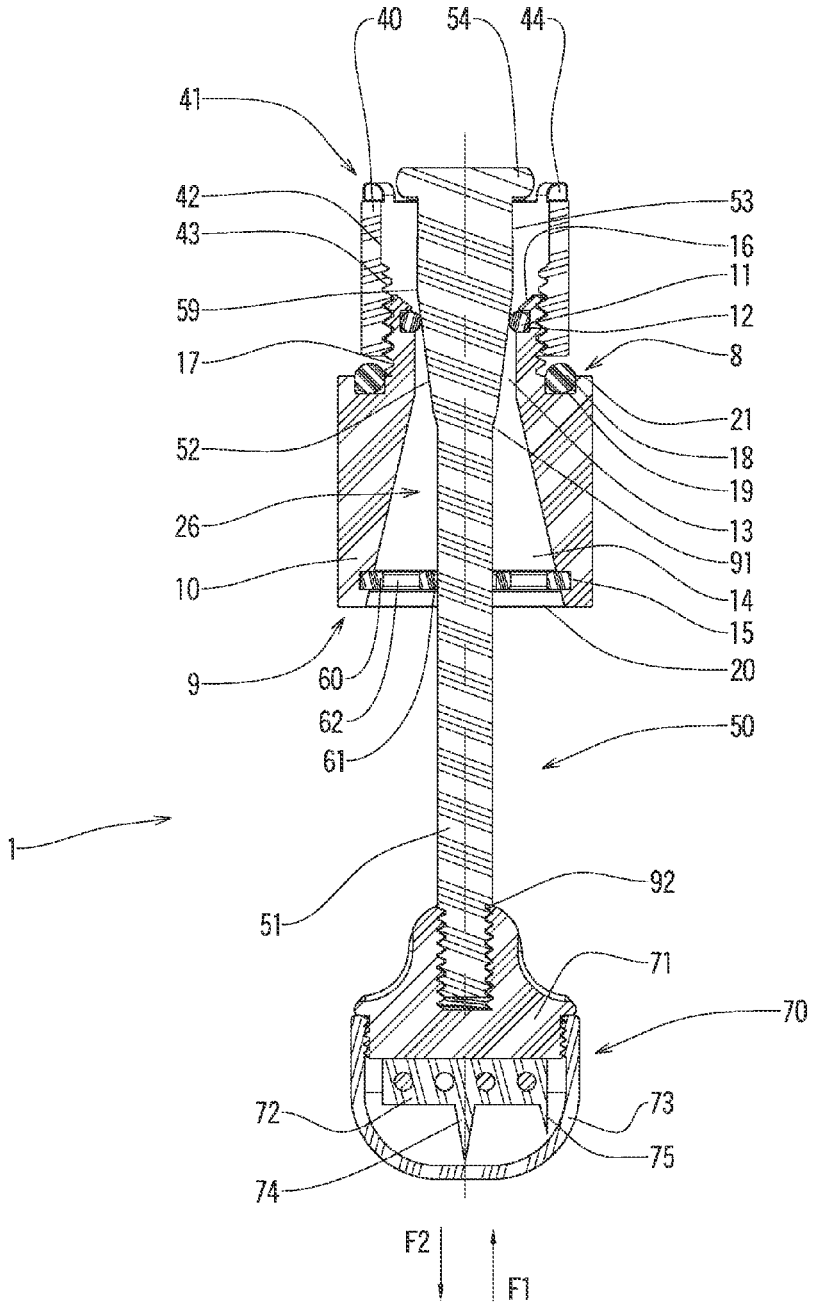
FIG. 4 is a cross-sectional view of the gravity-actuated tap of FIG. 1 along line A-A in a first position.
Figure 5:
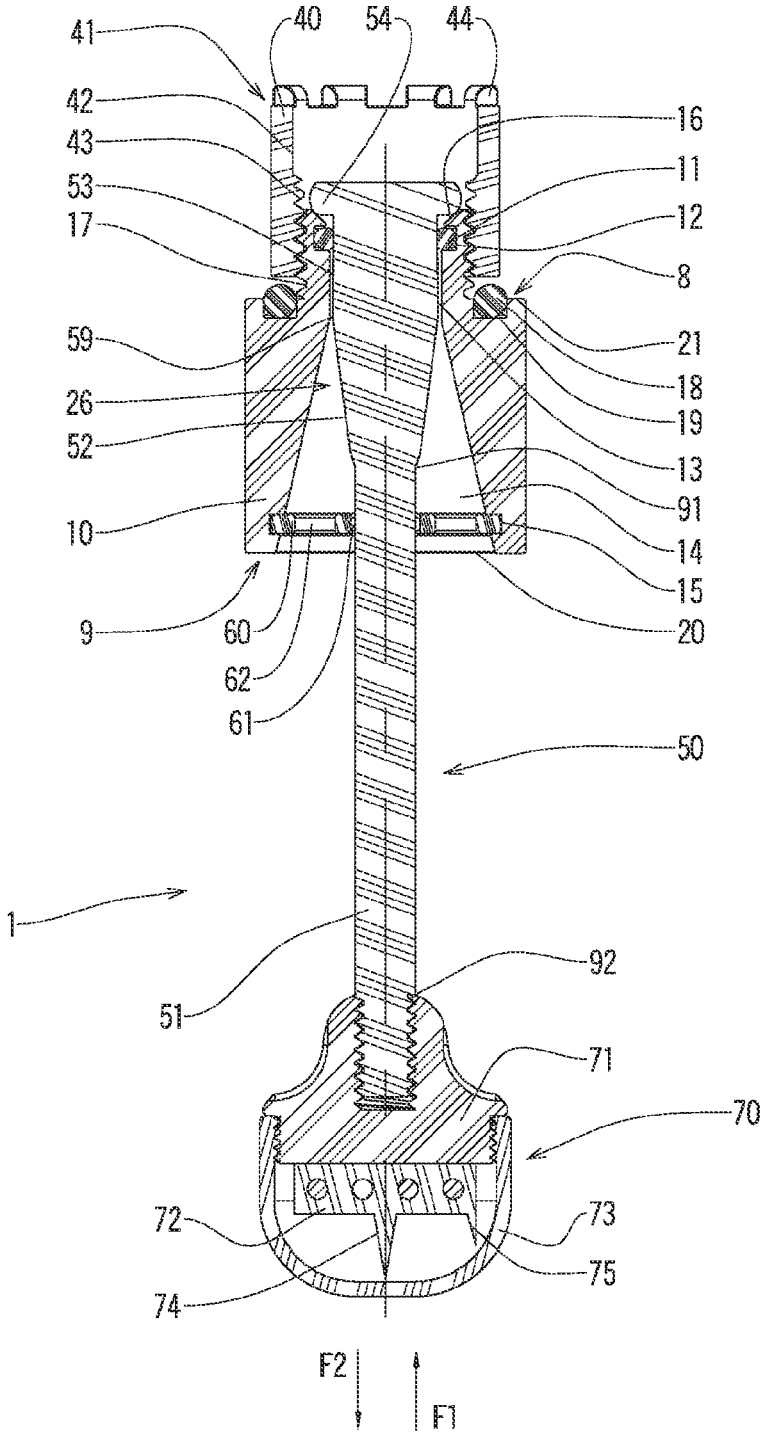
FIG. 5 is a cross-sectional view of the gravity-actuated tap of FIG. 1 along line A-A in an second position.
Figure 6:
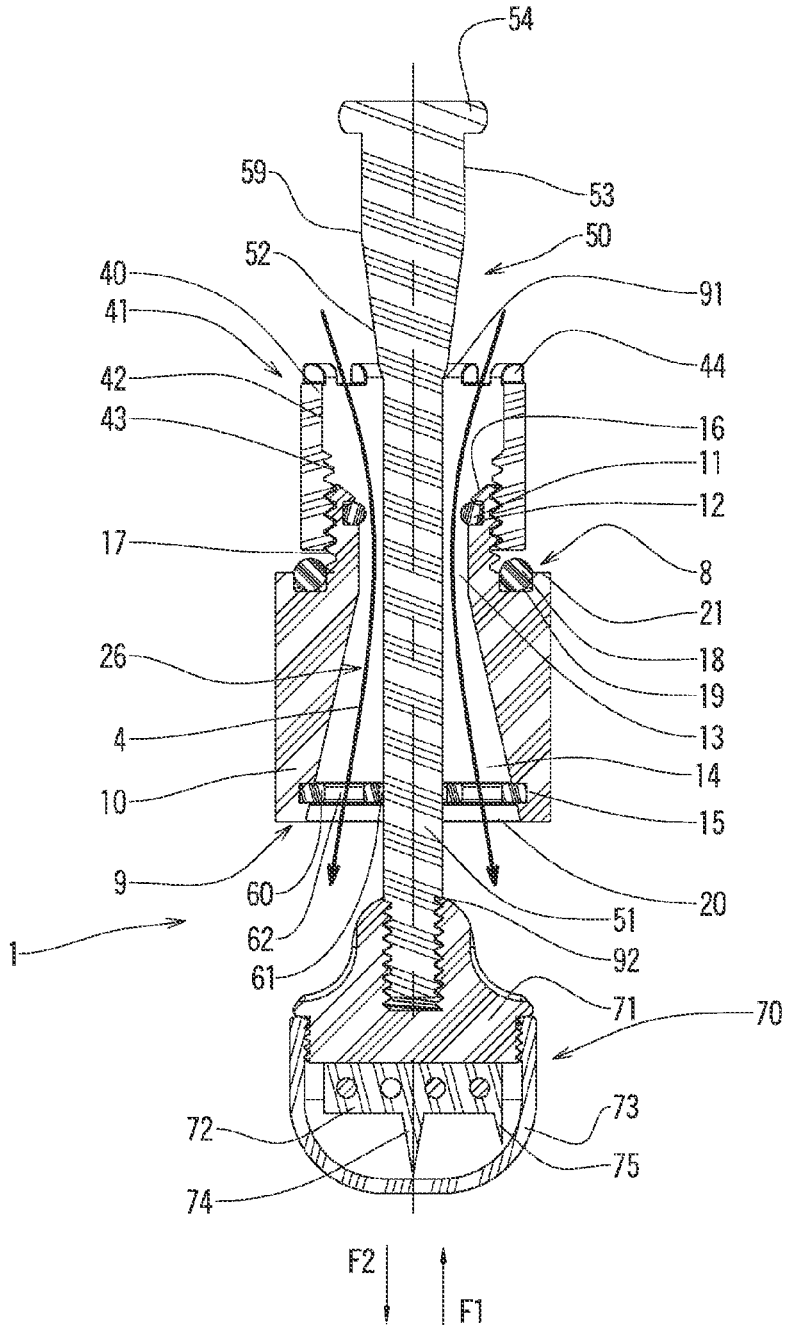
FIG. 6 is a cross-sectional view of the gravity-actuated tap of FIG. 1 along line A-A in a third position.

FIGS. 4 to 6 are cross-sectional views of one embodiment of the gravity-actuated tap 1 along line A-A of FIG. 1 wherein the plunger 50 is in a first position, a second position, and a third position respectively. In the first and second positions, flowable material 4 is prevented from flowing from the container 2, through the inlet 13 and outlet 14, and out the mouth 20. In the third position, flowable material 4 can flow from the container 2, though the inlet 13 and outlet 14, and out the mouth 20.

In one embodiment, when the plunger 50 is in the first position, the first sealing surface 52 is engaged with the first sealing element 11. The weight of the handle assembly 70 may contribute to holding the plunger 50 in the first position. When the plunger 50 is in the second position, the second sealing surface 53 is engaged with the first sealing element 11. When the plunger 50 is in the third position, a portion of the first sealing surface 52 may limit the longitudinal range of motion of the plunger 50 in the channel 26. In embodiments wherein a handle assembly 70 is present (see "Handle Assembly" below), the handle assembly 70 also limits the longitudinal range of motion of the plunger 50 in the channel 26. In embodiments wherein a plunger aperture 61 is present, the plunger aperture 61 may also limit the longitudinal range of motion of the plunger shaft 51 within the channel 26.

From the first or second positions, a force F1 may be applied to the plunger 50 to move the plunger 50 through the channel 26 until neither the first sealing surface 52 nor the second sealing surface 53 is engaged with the first sealing element 11, placing the plunger 50 in the third position. The magnitude of the force F1 required to move the plunger 50 from the first position to the third position is small. The requirement for only a small magnitude of force may be advantageous, for example when the container 2 is to be used while suspended from a flexible line. The magnitude of the force F1 required to move the plunger 50 from the second position to the third position is greater than the magnitude of the force F1 to move between the first and third positions, which may be advantageous for example when the container 2 is being transported with the gravity-actuated tap 1 installed, as the plunger 50 is less likely to be moved from the second to the third positions as a result of force F1 being applied to the plunger unintentionally.

In the third position, a flow rate of the flowable material 4 from the mouth 20 may be selected by varying the extent to which the plunger 50 is inserted into the body 10, which will vary the cross-sectional area (transversely to the length of the channel 26) of a flow path between the plunger 50 and the body 10 through which the flowable material 4 will flow. When force F1 is removed from the plunger 50, the plunger 50 will drop back into the first position under the force of gravity.

From the first or third positions, a force F2 may be applied to the plunger 50 to drop the plunger 50 through the channel 26 until the first sealing surface 52 is beyond the first sealing element 11 and the second sealing surface 53 is engaged with the first sealing element 11 to form a second seal, placing the plunger 50 in the second position. In one embodiment, the plunger stop 54 abuts with the plunger seat 16 in the third position.

The cross-sectional area of the plunger 50 transversely to the length of the channel 26 is greater over at least a portion of the second sealing surface 53 than at least a portion of the first sealing surface 52. In one embodiment, the plunger 50 is biased to remain in the second position. To move the plunger 50 from the second position, the force F1 must be sufficient to disengage the second sealing surface 53 from first sealing element 11 and move the second sealing surface 53 of the plunger 50 beyond the first sealing element 11. Thus, the plunger 50 may remain in the second position when the force F1 is insufficient to disengage the second sealing surface 53 from first sealing element 11 is accidentally applied on the handle assembly 70 or plunger 50.

Alignment of Plunger

In one embodiment, the body 10 may include a guiding element 60 to restrict lateral movement of the plunger 50. For example, the plunger shaft 51 may be movable longitudinally through the inlet 13, outlet 14, and guiding element 60, while lateral movement of the plunger shaft 51 is restricted by the guiding element 60. The restricted lateral range of motion may mitigate the disadvantages of using a gravity-actuated tap attached to a container that is not in a substantially vertical position. For example, the guiding element 60 may allow some embodiments of the gravity-actuated tap to be used at angles of up to about 45 degrees off vertical. In contrast, absent the guiding element 60, some embodiments of the gravity-actuated tap may be used at angles of up to about 15 degrees off vertical.

In one embodiment, the guiding element 60 may be a circular plate with a plunger aperture 61. The plunger aperture 61 may be located in the center of the guiding element 60 and may be circular to correspond to the shape of the plunger shaft 51. The guiding element 60 may include one or more fluid flow apertures 62. For example, a plurality of flow apertures 62 may be spaced apart around the plunger aperture 61. Regular spacing of the flow aperture 62 about the plunger aperture 61 provides a substantially even distribution of the flowable material 4 when dispensed from container 2 through the gravity-actuated tap 1. In one embodiment, the guiding element 60 is positioned in the channel 26. For example, the guiding element 60 may be located within the outlet 14. In one embodiment, the body 10 may include a guiding element groove 15 to house the guiding element 60.

Sealing Surfaces on Body

Figure 7:
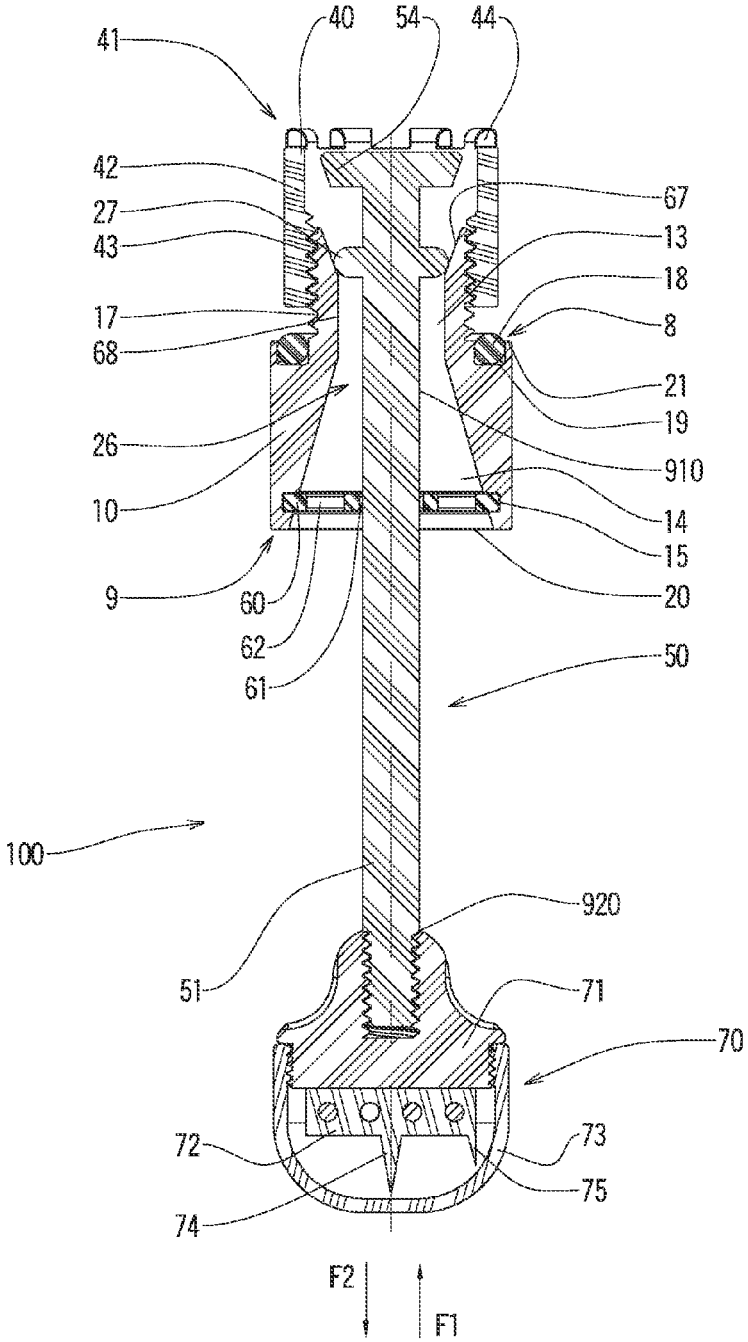
FIG. 7 is a cross-sectional elevation view of a gravity-actuated tap in a first position.
Figure 8:
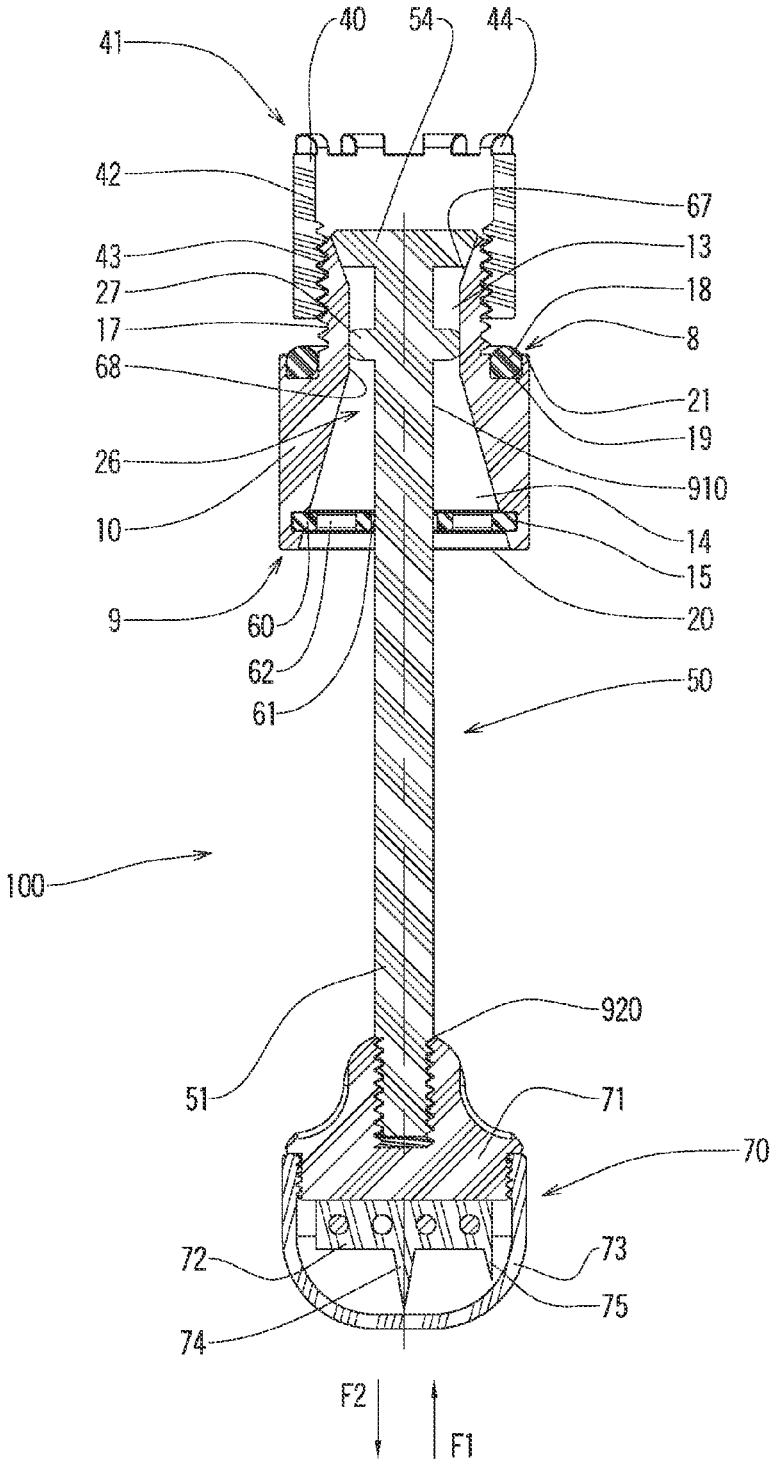
FIG. 8 is a cross-sectional view of the gravity-actuated tap of FIG. 7 along line A-A in an second position.
Figure 9:
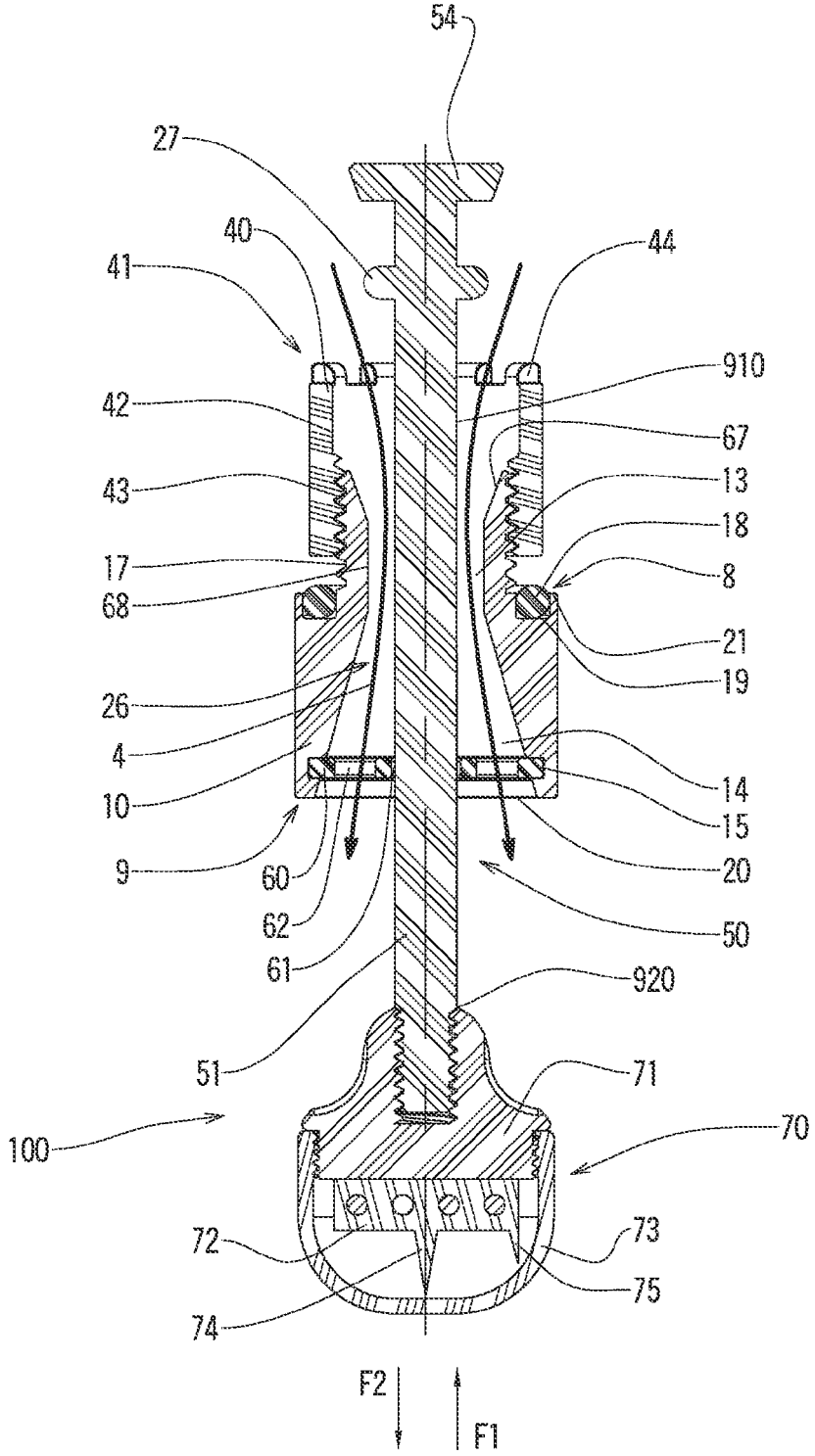
FIG. 9 is a cross-sectional view of the gravity-actuated tap of FIG. 7 along line A-A in a third position.

FIGS. 7 to 9 are cross-sectional elevation views of one embodiment of a gravity-actuated tap 100 in the first, second, and third positions respectively. The body 10 includes a first body sealing surface 67 proximate the first body end 8, and a second body sealing surface 68 intermediate the first body sealing surface 67 and the second body end 9. The channel 26 has a greater cross-sectional area transversely to the length of the channel 26 along at least a portion of the first body sealing surface 67 than along at least a portion of the second body sealing surface 68. The plunger 50 includes a plunger shaft 51 with a first plunger shaft end 910 and a second plunger shaft end 920. When the gravity-actuated tap 100 is in the first position, the first seal forms between the plunger 50 and the first body sealing surface 67. When the gravity-actuated tap 100 is subjected to a sufficient force F2 to enter the second position, the second seal forms between the plunger 50 and the second body sealing surface 68. When the gravity-actuated tap 100 is subjected to sufficient force F1 to enter the third position, flowable material 4 can flow though the inlet 13 and outlet 14, and out the mouth 20.

In one embodiment, the plunger 50 includes a plunger sealing shoulder 27 extending from the plunger 50 to form the first seal with the first body sealing surface 67, and to form the second seal with the second body sealing surface 68.

In one embodiment, the cross-sectional area of the channel 26 transversely to the length of the channel 26 decreases along the first body sealing surface 67 from the first body end 8 toward the second body end 9. For example, the channel 26 may be frustoconical along the first body sealing surface 67.

In one embodiment, the cross-sectional area of the channel 26 transversely to the length of the channel 26 increases along the second body sealing surface 68 from the first body sealing surface 67 toward the second body end 9. For example, the channel 26 may be frustoconical along the first second sealing surface 68.

In one embodiment, the first body sealing surface 67 may function as a plunger seat similarly to the plunger seat 16 of FIG. 2. In one embodiment, the plunger further includes a plunger stop 54 extending from the plunger 50. The plunger stop 54 may abut the first body sealing surface 67 when the plunger 50 is in the second position.

FIG. 10 is a cross-sectional elevation view of an embodiment of the gravity-actuated tap 100 in a first position wherein the plunger 50 includes the first sealing element 11. The first seal is formed between the first sealing element 11 and the first body sealing surface 67. The second seal is formed between the first sealing element 11 and the second body sealing surface 68. In one embodiment, the plunger 50 may include a plunger groove 56 to house the first sealing element 11. Alternatively, the first sealing element 11 may be affixed to the plunger 50 in any manner that a skilled person would understand to be suitable.

Figure 11:
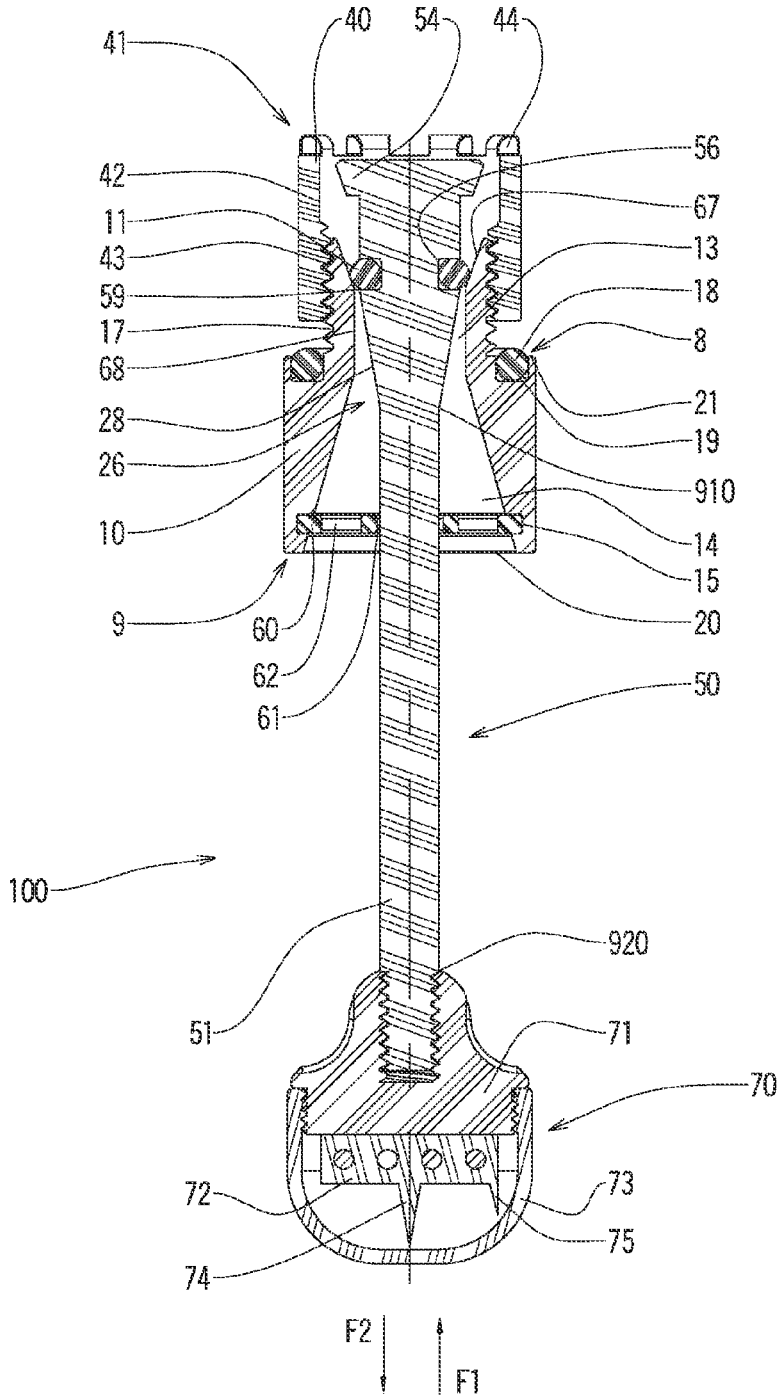
FIG. 11 is a cross-sectional elevation view of a gravity-actuated tap in a first position.

FIG. 11 is a cross-sectional elevation view of an embodiment the gravity-actuated tap 100 in a first position wherein the plunger 50 includes a sealing element retention portion 28 extending from the first plunger shaft end 910. The sealing element retention portion 28 allows the first sealing element 11 to be affixed to a portion of the plunger 50 with a greater cross-sectional area transversely to the length of the channel 26 than the plunger shaft 51. The sealing element retention portion 28 facilitates provision of a narrower plunger shaft 51 in the channel 26 when the plunger 50 is in the third position, which may allow a greater flow rate through the channel 26. The sealing element retention portion 28 mitigates the need to narrow the plunger 50 where the first sealing element 11 is affixed to the plunger 50.

Body with Sealing Shoulder

FIG. 12 is a cross-sectional elevation view of one embodiment of the gravity-actuated tap 1 in the first position, the body 10 having a sealing shoulder 24 wherein a seal is formed between the first sealing surface 52 and the body 10. Similarly, in the second position (not shown), a seal is formed between the second sealing surface 53 and the body 10. The body 10 includes a sealing shoulder 24 proximate the inlet 13. A seal between the plunger 50 and the body 10 may be formed at the sealing shoulder 24. The sealing shoulder 24 may have any suitable shape and size. In one embodiment, the sealing shoulder may be circular in plan view. Alternatively, the sealing shoulder 24 may for example be ovular, square, rectangular, or any suitable shape in plan view.

Plunger with Sealing Cavity

In one embodiment, the plunger 50 may include a sealing cavity 57, as shown in FIG. 12. The sealing cavity 57 allows contraction of the plunger 50 when the plunger 50 is in the second position. Contraction of the plunger 50 facilitates movement of the plunger 50 between the first and second positions. The sealing cavity 57 may be formed in a portion of the plunger 50 corresponding to the second sealing surface 53. The sealing cavity 57 may further also be formed in a portion of the plunger 50 corresponding to the first sealing surface 52. The portion of the plunger 50 having the sealing cavity 57 formed therein contracts when the plunger 50 is in the second position. The portion of the plunger 50 having the sealing cavity 57 formed therein is made at least in part from semi-rigid, soft material, flexible, or resilient materials. Examples of suitable materials include polyethelyne plastic, rubber, or other flexible polymers.

Examples of Connectors

In one embodiment, the connector may be an extension 17, as described above. The extension 17 may abut the aperture 31 to form a seal at the second sealing element 18. When a seal is not formed between the second sealing element 18 and the cap 3 or container 2, flowable material 4 may leak from the aperture 31. A fastener 40 may engage extension 17 and provide additional force between the second sealing element 18 and the cap 3 or container 2, improving the seal.

In one embodiment, the fastener 40 may include features to facilitate installation of the gravity-actuated tap 1. The fastener 40 and extension 17 may be threaded for a mating engagement, for example the extension 17 is threaded and engages the fastener 40 at a fastener thread 43 to install the body 10 on the fastener 40.

In one embodiment, a crown 41 may engage the fastener 40. The crown 41 allows additional friction between a user's fingers and the fastener 40, facilitating ease of installation of the gravity-actuated tap 1. The crown 41 shown in FIGS. 2 and 3 may include multiple extensions 44 to increase the contact friction between the user's fingers and the fastener 40. Alternatively, any textured portion, gripper, extension, or other means to increase contact friction between the user's fingers and the fastener 40 may be an alternative to the crown 41. In one embodiment, a portion 42 of the fastener 40 may extend into the cap 3 to allow convenient gripping of the fastener 40 by the user's fingers during installation of the gravity-actuated tap 1. The portion 42 may be threaded or unthreaded.

Figure 13:
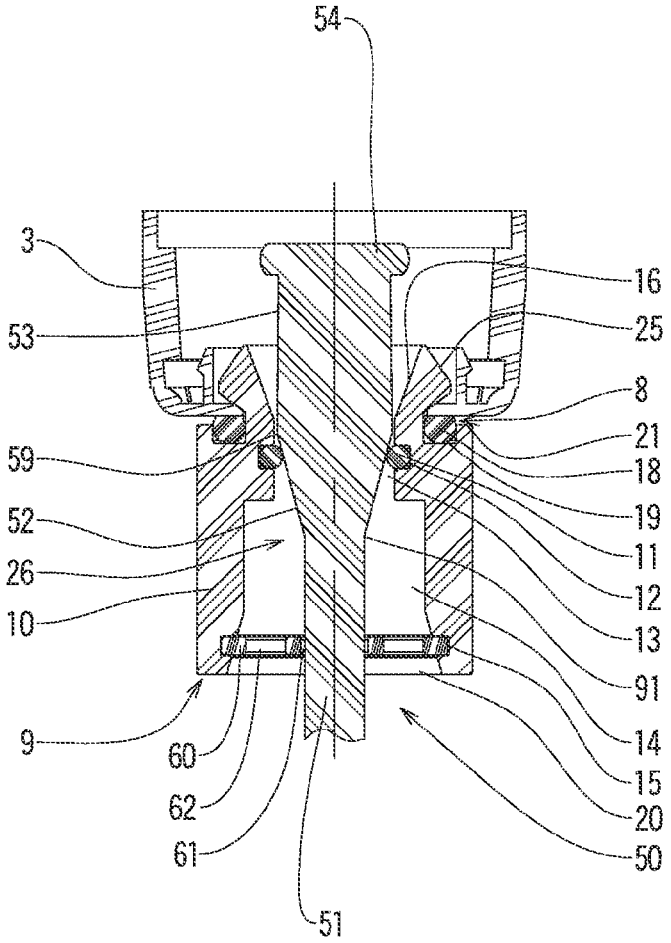
FIG. 13 is a cross-sectional elevation detail view of a gravity-actuated tap in a first position.
Figure 14:
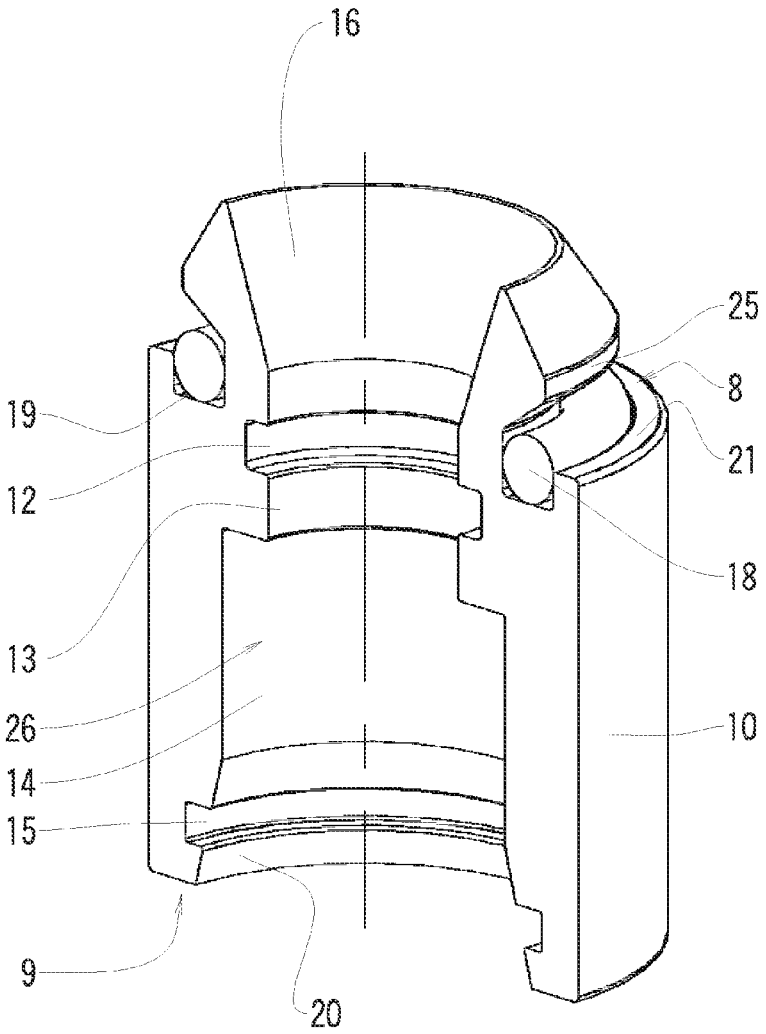
FIG. 14 is a partial cutaway perspective view of a gravity-actuated body of the gravity-actuated tap of FIG. 13.

FIGS. 13 and 14 are a cross-sectional elevation view of one embodiment of the gravity-actuated tap 1 in the first position, and a partial cutaway perspective view of the body 10 of the gravity-actuated tap 1 of FIG. 13, respectively. In the embodiment of FIGS. 13 and 14, the connector is a collar 25 extending from the first body end 8. The collar 25 engages with the cap 3 or container 2 (not shown) and has a sufficiently large cross-sectional area transversely to the length of the channel 26 to secure the body 10 in the aperture 31.

Figure 15:
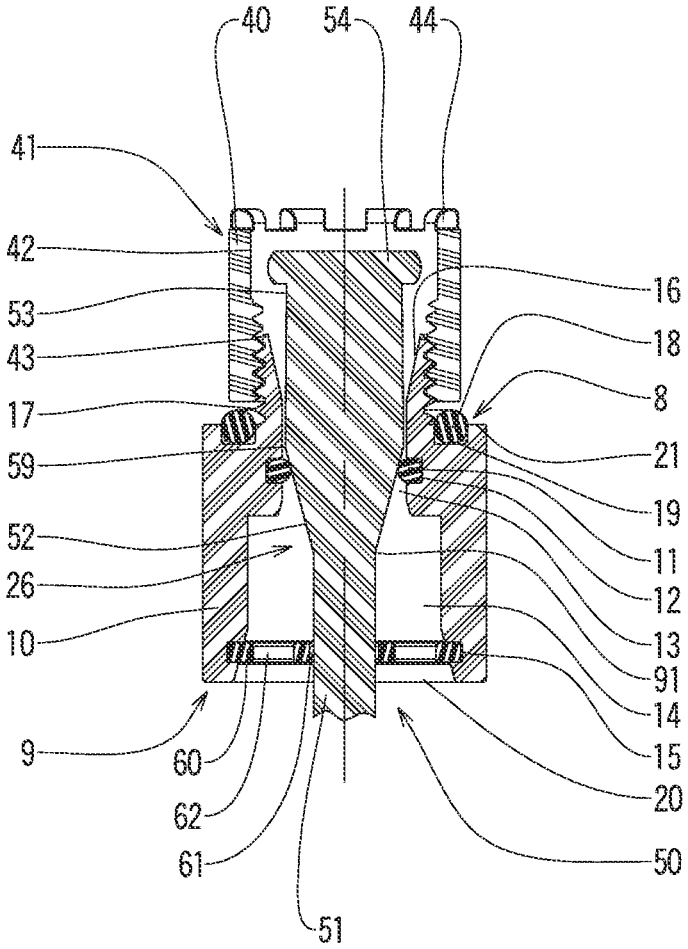
FIG. 15 is a cross-sectional elevation detail view of a gravity-actuated tap in a first position.

FIG. 15 is a cross-sectional elevation view of one embodiment of the gravity-actuated tap 1 in the first position wherein the first sealing element 11 is located in a portion of the inlet 13 that is not coincident with the extension 17. The extension 17 has a sufficiently small outer diameter to engage with the fastener 40. When the first sealing element groove 12 is located in a portion of the inlet 13 that is coincident with the extension 17, the first sealing element groove 12 is sufficiently shallow that the threaded part of extension 17 is not weakened. Conversely, when the first sealing element groove 12 is located in a portion of the inlet 13 that is not coincident with the extension 17, the first sealing element groove 12 may be deeper. This allows the first sealing element 11 to be recessed further into the body 10, increasing the cross-sectional area of the flow path through the inlet 13 in the third position. Alternatively, the cross-sectional area of first sealing element 11 as shown in FIG. 15 may be larger, which may provide a more durable sealing element 11.

Tap without Centralizer, Second Sealing Element, or Knife

Figure 16:
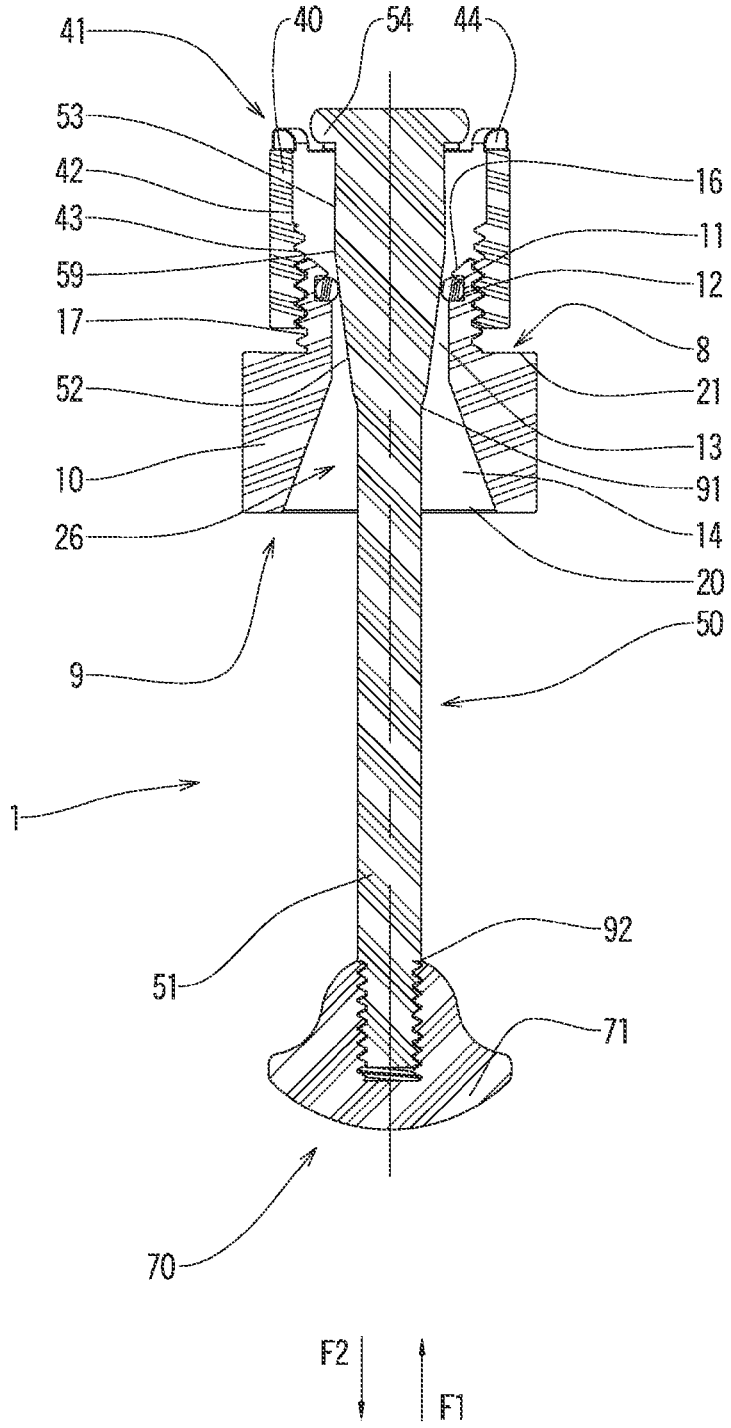
FIG. 16 is a cross-sectional elevation view of a gravity-actuated tap in a first position.

FIG. 16 is a cross-sectional elevation view of one embodiment of a gravity-actuated tap 1 in the first position wherein the guiding element 60 and guiding element groove 15, and the second sealing element 18 and the second sealing element groove 19, are absent from the body 10. The handle assembly 70 of the gravity-actuated tap 1 of FIG. 16 includes only the handle 71.

Sealing Between the Plunger and the Body

Figure 17:
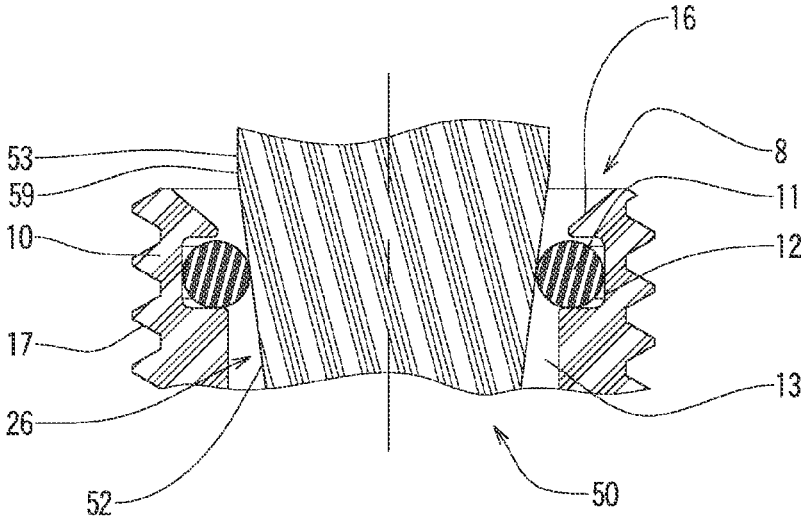
FIG. 17 is a cross-sectional elevation view of a seal in the gravity-actuated tap of FIG. 1.

FIG. 17 is a cross-sectional elevation view of a portion of the plunger 50 and body 10 of the gravity-actuated tap 1 of FIG. 1. The first sealing element 11 shown in FIG. 17 is an o-ring. O-rings are readily available and simplify manufacturing of the body 10.

Figure 18:
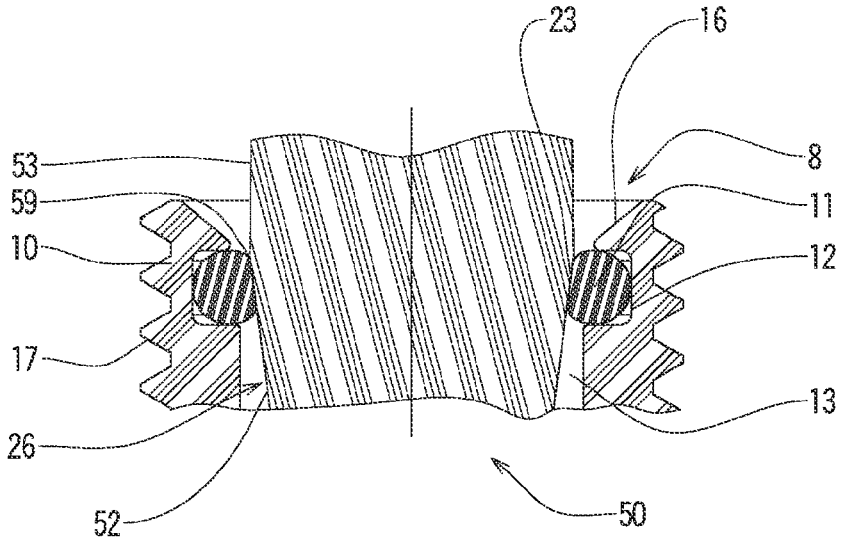
FIG. 18 is a cross-sectional elevation view of a seal in a gravity-actuated tap.

FIG. 18 is a cross-sectional elevation view of one embodiment of the gravity-actuated tap 1. The first sealing element 11 has a frustonical shape and is seated in the first sealing element groove 12. The frustoconical-shaped first sealing element 11 has a first sealing element inner surface 23 which contacts the plunger 50. The angle of the first sealing element inner surface 23 is substantially equal to an angle of inclination of the first sealing surface 52. The frustoconical-shaped first sealing element 11 provides a greater contact area between the frustoconical-shaped first sealing element 11 and the plunger 50 relative to the contact area between a circular shaped first sealing element 11 and the plunger 50.

Figure 19:
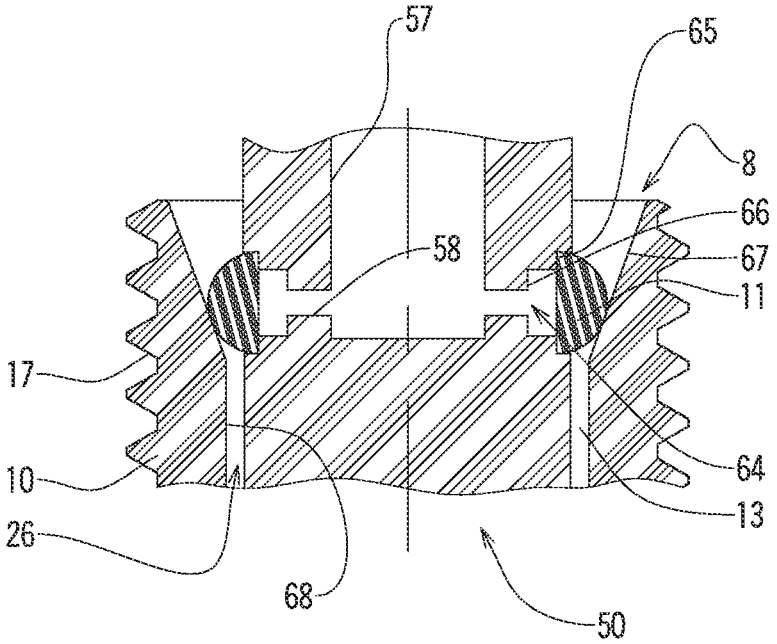
FIG. 19 is a cross-sectional elevation view of a seal in a gravity-actuated tap.

FIG. 19 is a cross-sectional elevation view of a plunger 50 of one embodiment of the gravity-actuated tap 100 wherein the first sealing element 11 has a half-o-ring shape and the sealing cavity 57 is formed in the plunger 50 proximate the first plunger shaft end 910. The plunger 50 may include a shouldered plunger groove 64. The shouldered plunger groove 64 has an outer shoulder 65 and an inner shoulder 66. The half-o-ring-shaped first sealing element 11 abuts the plunger 50 on the outer shoulder 65. A relief channel 58 provides fluid communication between the sealing cavity 57 and the shouldered plunger groove 64.

The half-o-ring-shaped first sealing element 11 may expand into the shouldered plunger groove 64 when a seal is formed between the half-o-ring-shaped first sealing element 11 and the body 10. The half-o-ring-shaped first sealing element 11 may expand into the shouldered plunger groove 64 to a greater degree under a second seal between the half-o-ring-shaped first sealing element 11 and the body 10 at the second body sealing surface 68 compared to a first seal between the half-o-ring-shaped first sealing element 11 and the first body sealing surface 67. The relief channel 58 allows fluids that may otherwise become trapped between the half-o-ring sealing element 63 and the shouldered plunger groove 64 to flow to the sealing cavity 57 and out of the plunger 50, facilitating movement of the plunger between the first and second positions.

Handle Assembly

In one embodiment, the gravity-actuated tap 1 may include a knife to cut or tear the aperture 31 in the cap 3 or in the container 2, or to introduce a vent hole 5 in the container 2.

The handle assembly 70 may include a handle 71 extending from the plunger shaft 51, a knife 72 extending from the handle 71, and a knife guard 73. The knife guard 73 may be reversibly positioned about the knife 72 and extend from the handle 71.

The handle 71 may be reversibly attached to the to the plunger shaft 51 by a threaded connection as discussed above. Alternatively, the handle 71 may be attached to the plunger shaft 51 by other means, for example glue, molding, or by an attachment peg (not shown). The knife 72 extends from the handle 71. The knife guard 73 nests about the knife 72 to reduce the likelihood of accidental injuries caused by the knife 72. The knife guard 73 may threadedly engage with the handle 71, or may engage with the handle 71 by friction fit or other means (not shown). The handle 71 and the knife guard 73 may for example have a circular shape in plan view (i.e. being cylindrical or frustoconical in shape).

Figure 22:
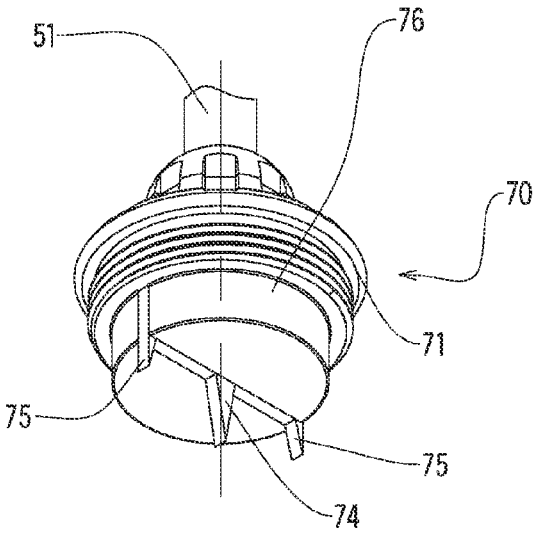
FIG. 22 is a perspective view of the handle assembly of FIG. 20.

In an embodiment, the knife 72 includes an anchor spike 74 and one or more cutting spikes 75 (shown here as flat cutting spikes). The anchor spike 74 may be located in the center of the handle 71 while the cutting blade may be located on the periphery of the handle 71. In use, the anchor spike 74 may first puncture the cap 3 or container 2. The cutting spike 75 may then be rotated about the anchor spike 74 to cut or tear the aperture 31. The knife 72 may have an overall flat shape (FIGS. 3 and 22). The anchor spike 74 and the cutting spike 75 may similarly be flat. Alternatively, the anchor spike 74 may be a conical spike or a cylindrical and conical spike (see FIGS. 25 to 27).

Figure 20:
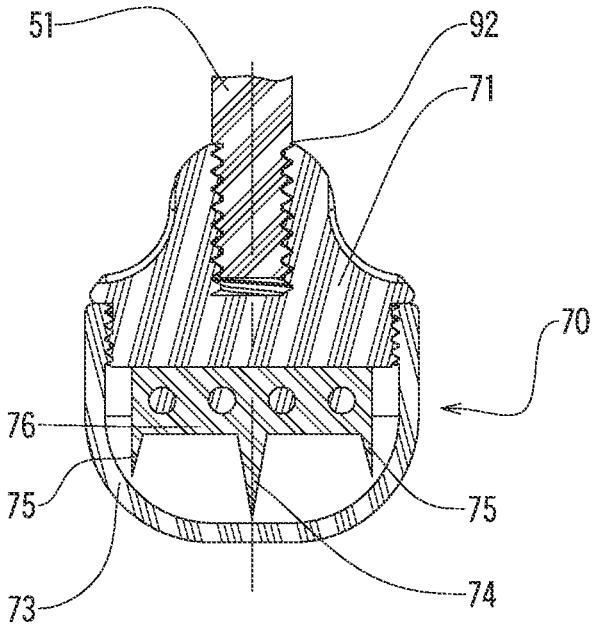
FIG. 20 is a cross-sectional elevation view of a handle assembly.
Figure 21:
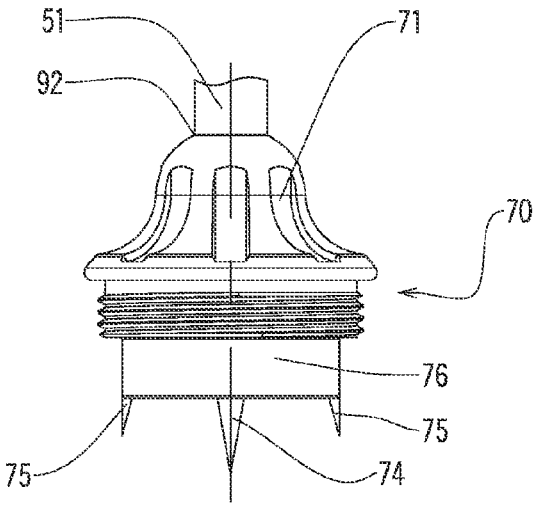
FIG. 21 is an elevation view of the handle assembly of FIG. 20.

FIGS. 20 to 22 are respectively cross-sectional elevation, elevation, and perspective views of an embodiment of the handle assembly 70 with a dual-cutting spike knife 76. The dual-cutting blade knife 76 includes an anchor spike 74 and two cutting spikes 75. The dual-cutting spike knife 76 has a flat plate shape. Two cutting spikes 75 will allow cutting the aperture 31 with less rotation than would be the case with one cutting spike 75. Similarly, a knife with three or more cutting spikes located at even radial intervals would cut the aperture 31 with still less rotation.

Figure 23:
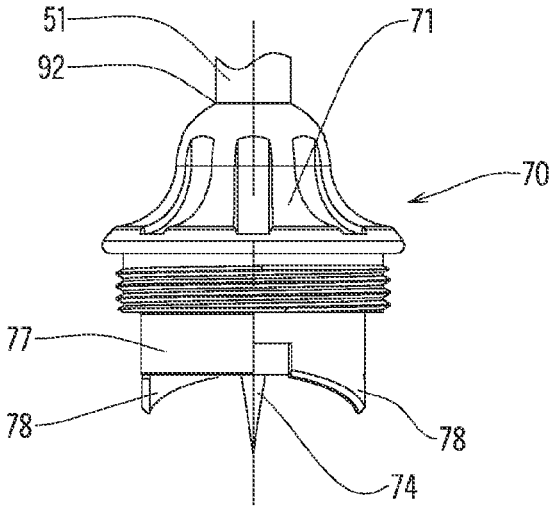
FIG. 23 is an elevation view of a handle assembly.
Figure 24:
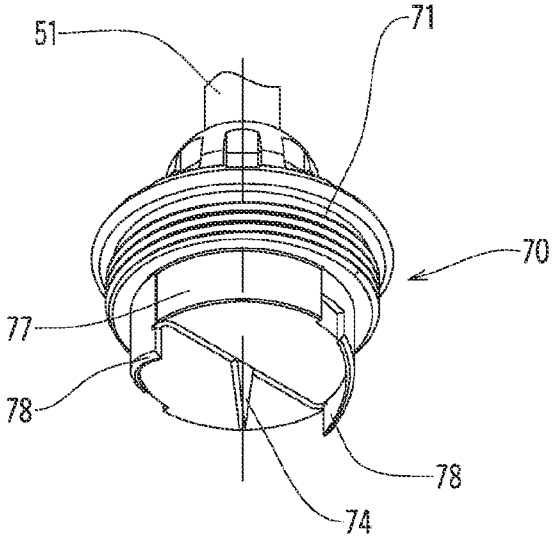
FIG. 24 is a perspective view of the handle assembly of FIG. 23.

FIGS. 23 and 24 are respectively elevation and perspective views of an embodiment of the handle assembly 70 with a curved-cutting blade knife 77. The curved-cutting blade knife 77 includes an anchor spike 74 and two curved cutting blades 78. The curved cutting blades 78 are curved and have variable height to facilitate cutting on inclined surfaces relative to the cutting blades 75.

Figure 25:
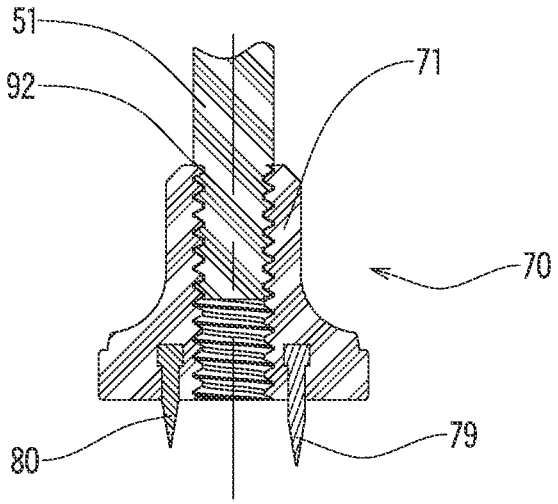
FIG. 25 is a cross-sectional elevation view of a handle assembly.
Figure 26:
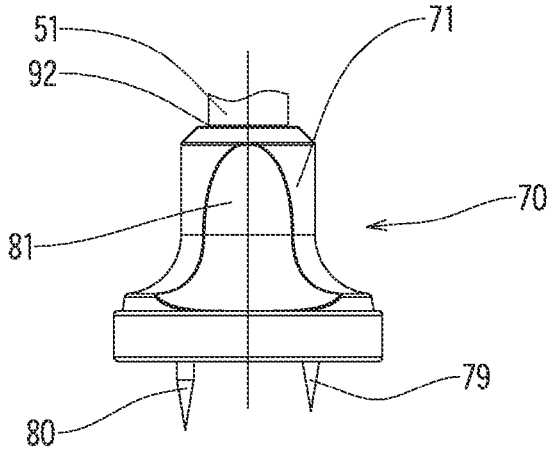
FIG. 26 is an elevation view of the handle assembly of FIG. 25.
Figure 27:
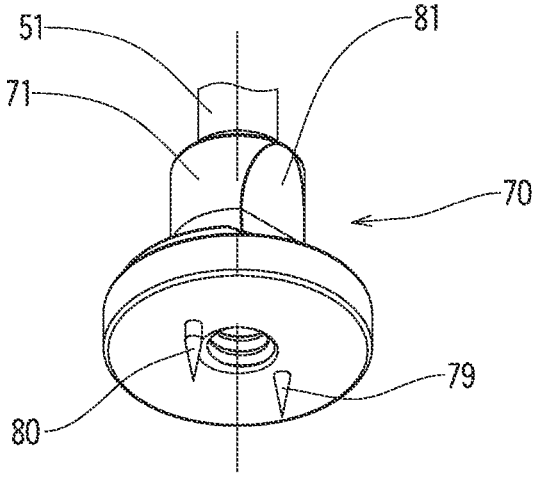
FIG. 27 is an perspective view of the handle assembly of FIG. 25.

FIGS. 25 to 27 are respectively cross-sectional elevation, elevation, and perspective views of an embodiment of the handle assembly 70 with a conical anchor spike 79 and a cylindrical and conical cutting spike 80. Other anchor and cutting spike shapes that are neither flat, conical, nor cylindrical and conical will also work. The handle 71 may include gripping surfaces 81 to facilitate cutting of the hole 31.

Examples Only

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art without and the claims should be given the broadest interpretation consistent with the description as a whole.

What is claimed is:

1. A tap for dispensing a flowable material from a container, the tap comprising:

a body having a channel extending longitudinally between a first body end and a second body end, the channel including an inlet for receiving the flowable material and an outlet for discharging the flowable material, the channel arranged for flow of the flowable material therethrough;

an elongate plunger movable generally axially along a length of the channel, between a first position and a second position, and between the first position and a third position, the plunger comprising:

a plunger shaft having a first plunger shaft end and a second plunger shaft end;

a first sealing surface proximate the first plunger shaft end to form a first seal with the body when the plunger is in the first position, wherein at least a portion of the first sealing surface has a greater cross-sectional surface area transversely to the length of the channel than at least a portion of the plunger shaft; and a second sealing surface proximate the first sealing surface to form a second seal with the body when the plunger is in the second position, wherein at least a portion of the second sealing surface has a greater cross-sectional surface area transversely to the length of the channel than at least a portion of the first sealing surface;

a plunger stop proximate the first sealing surface and the second sealing surface to abut the body when the plunger is in the second position;

wherein when the plunger is in the third position, the plunger is positioned for providing a flow of the flowable material through the channel;

a handle connected to the second plunger shaft end; and a connector for attaching the tap to the container;

wherein, when the tap is disposed generally vertically such that the handle is generally vertically below the body:

the plunger is movable from the first position in which the plunger is positioned to inhibit the flow of flowable material to the third position in which the plunger is positioned for flow of the flowable material through the channel by manual application of a force to the handle to move the plunger vertically upwardly, against the force of gravity, to facilitate the flow of the flowable material;

the plunger is automatically moved from the third position to the first position by the force of gravity acting on the handle and the plunger when the manual application of the force to the handle is discontinued such that the plunger always moves from the third position to the first position when no manual force that opposes the force of gravity is applied; and the plunger is movable from the first position to the second position by a force applied to the handle to move the handle generally vertically away from the body and thereby pull the plunger into the second position in which the second sealing surface forms the second seal with the body, the plunger stop abuts the body, and the first sealing surface is out of sealing contact with the body.

2. The tap according to claim 1, wherein the cross-sectional surface area of the plunger increases along a length of the first sealing surface from the first plunger shaft end.

3. The tap according to claim 1, wherein the cross-sectional surface area of the plunger decreases along a length of the second sealing surface from the first sealing surface.

4. The tap according to claim 1, comprising a first sealing element affixed to the body to form the first seal with the first sealing surface and to form the second seal with the second sealing surface.

5. The tap according to claim 1, comprising a sealing shoulder extending from the body to form the first seal with the first sealing surface and to form the second seal with the second sealing surface.

6. The tap according to claim 1, wherein the connector is a collar extending from the first body end and at least a portion of the channel is coextensive with the collar.

7. The tap according to claim 1, wherein the connector comprises:

an extension extending from the first body end, wherein at least a portion of the channel is coextensive with the extension; and a fastener to engage the extension.

8. The tap according to claim 7, wherein the extension is a threaded extension and the fastener is a nut.

9. The tap of claim 1, comprising a second sealing element affixed to the body proximate the first body end to form a third seal between the tap and the container.

10. The tap according to claim 1, comprising a guiding element affixed to the body for guiding the plunger along the length of the channel.

11. The tap according to claim 10, wherein the plunger extends through a plunger aperture of the guiding element, the plunger aperture for restricting lateral motion of the plunger.

12. The tap according to claim 1, a wherein the plunger stop extends from the second sealing surface to abut the body proximate the first body end when the plunger is in the second position.

13. The tap according to claim 12, comprising a plunger seat proximate the first body end for receiving the plunger stop.

14. The tap of claim 1, comprising a sealing cavity formed in a portion of the plunger proximate the second sealing surface to facilitate movement of the plunger between the first and second positions.

15. A tap for dispensing a flowable material from a container, the tap comprising:

a body having a channel extending longitudinally between a first body end and a second body end, the channel including an inlet for receiving the flowable material and an outlet for discharging the flowable material, the channel arranged for flow of the flowable material therethrough;

an elongate plunger movable along a length of the channel, the plunger comprising:

a plunger shaft having a first plunger shaft end and a second plunger shaft end;

a first sealing surface proximate the first plunger shaft end to form a first seal with the body when the plunger is in a first position, wherein at least a portion of the first sealing surface has a greater cross-sectional surface area transversely to the length of the channel than at least a portion of the plunger shaft; and a second sealing surface proximate the first sealing surface to form a second seal with the body when the plunger is in a second position, wherein at least a portion of the second sealing surface has a greater cross-sectional surface area transversely to the length of the channel than at least a portion of the first sealing surface;

wherein when the plunger is in a third position, the plunger is positioned for providing a flow of the flowable material through the channel;

a connector for attaching the tap to the container;

a handle extending from the second plunger shaft end; and a knife proximate the handle for cutting an aperture in the container.

16. The tap of claim 15, comprising an anchor element proximate the handle to anchor the knife to the container while cutting an aperture in the container, and a cutter offset from the anchor element to rotationally cut the aperture while the anchor element is anchored to the container.

17. The tap according to claim 15, comprising a knife guard removably nested about the knife for enclosing the knife.

18. The tap according to claim 15 wherein the handle is removably attached to the second plunger end.

* * * * *